US011808462B1

(12) United States Patent
Castelle

(10) Patent No.: US 11,808,462 B1
(45) Date of Patent: Nov. 7, 2023

(54) PROCESS FOR PROVIDING RESIDENTIAL HEATING COMFORT DURING WINTER MONTHS WITHOUT USING FOSSIL FUELS AS AN ENERGY SOURCE

(71) Applicant: Jerry Castelle, Old Bethpage, NY (US)

(72) Inventor: Jerry Castelle, Old Bethpage, NY (US)

( * ) Notice: Subject to any disclaimer, the term of this patent is extended or adjusted under 35 U.S.C. 154(b) by 0 days.

(21) Appl. No.: 18/106,397

(22) Filed: Feb. 9, 2023

(51) Int. Cl.

| | |
|---|---|
| ***H05B 6/10*** | (2006.01) |
| ***H05B 6/80*** | (2006.01) |
| ***F24D 12/02*** | (2006.01) |
| ***F24V 50/00*** | (2018.01) |

(52) U.S. Cl.
CPC ..... *F24D 12/02* (2013.01); *F24V 50/00* (2018.05); *H05B 6/108* (2013.01); *H05B 6/802* (2013.01)

(58) Field of Classification Search
CPC ..... F24D 12/02; F24V 50/00; H05B 6/108; H05B 6/802
USPC ..... 219/601, 635, 672, 673, 674, 675, 676, 219/680, 681, 690
See application file for complete search history.

(56) References Cited

U.S. PATENT DOCUMENTS

| | | | | |
|---|---|---|---|---|
| 7,871,458 | B2 * | 1/2011 | Minkkinen | F24D 12/02 95/126 |
| 10,535,995 | B2 * | 1/2020 | Kawata | H04L 12/2829 |
| 11,204,170 | B2 * | 12/2021 | Semerad | F24C 3/006 |

* cited by examiner

*Primary Examiner* — Quang T Van

(57) ABSTRACT

The three steps herein provide warm heating comfort to a home without using fossil fuels. The First step involves a compost bin to decompose organic waste matter and thereby produce 165 degree F. temperature. The Second step uses a microwave oven located inside the attic to heat the polarized mineral oil of said latter temperature to 180 degrees F. The Third step involves wrapping an induction coil around ferrous pipe which then continues into rigid copper tubing outfitted with aluminum fins having pyramidal projections which impede the upward migration of warmed convection air currents.

2 Claims, 9 Drawing Sheets

Figure 1:
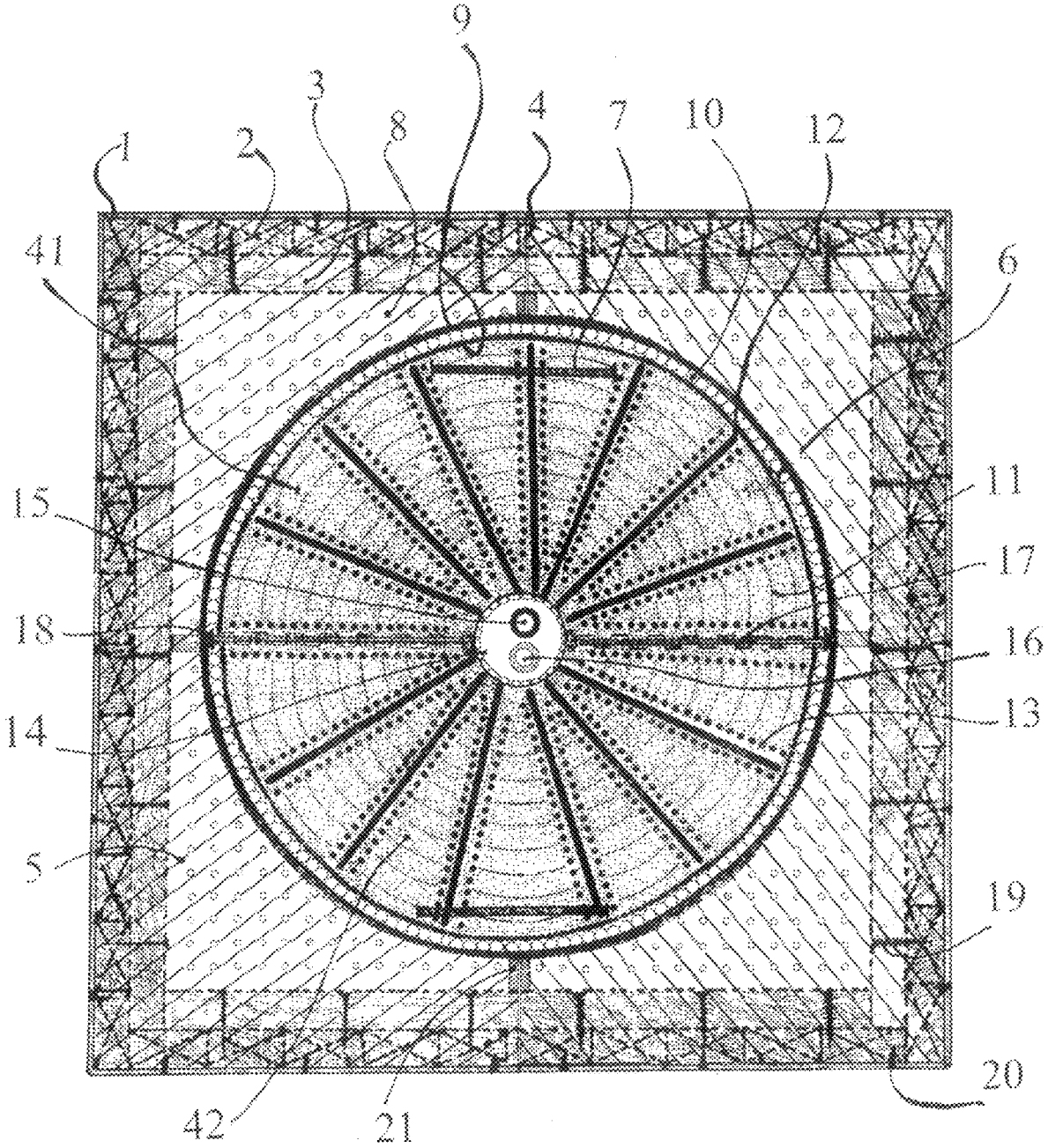

FIGURE 11
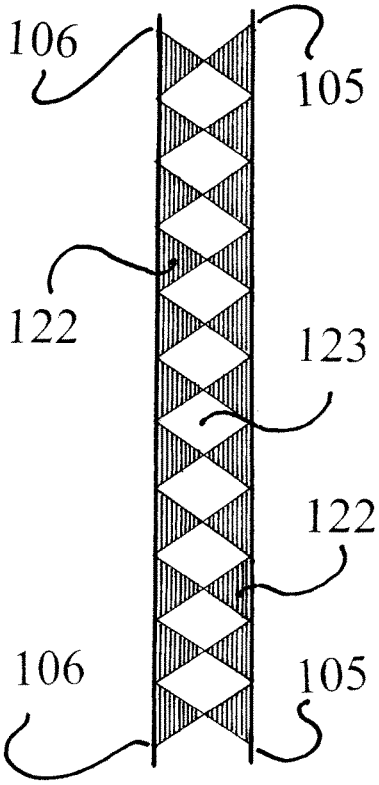
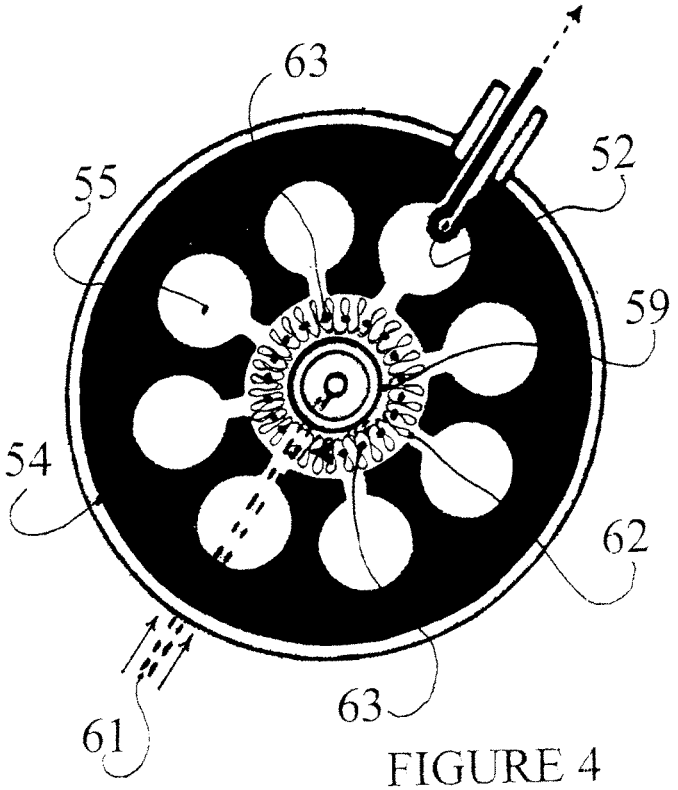
FIGURE 4
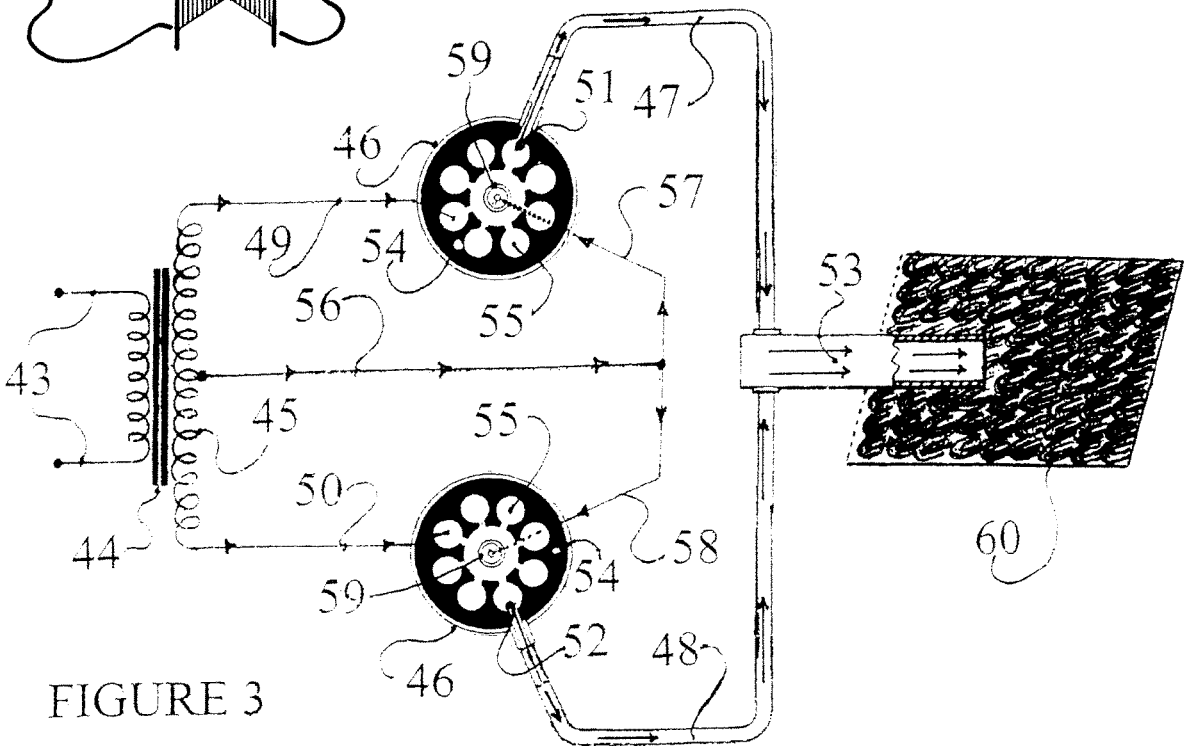
FIGURE 3

15
29
34
60
61
62
63
64
65
66
67
68
69
70
71
72
73
74
75
76
77
78
79
80
81
82
83
84
85
86
87
88
89
90
91

PROCESS FOR PROVIDING RESIDENTIAL HEATING COMFORT DURING WINTER MONTHS WITHOUT USING FOSSIL FUELS AS AN ENERGY SOURCE

BACKGROUND OF THE INVENTION

At present there are 195 million single family dwellings in the United States alone, where the majority of these homes, because of their location geographically are heated during the cold winter months, with either a system which employs forced hot air or hot water (hydronic) baseboard radiation. Either method has its limitations as being very expensive and costly; or else being detrimental as an existential threat; whereby both of these systems necessarily depend on fossil fuels for their energy source, which contributes to climate change and global warming. Next is the drawback of inefficiency, or wasted energy in accomplishing its mission. For example, the baseboard hot water radiation in a typical common dwelling starts at its beginning point, from the oil or gas boiler and thus travels in a closed loop using only one supply pipe and traverses typically 150 feet for the average house, before descending back to its original location; the boiler. This loop thus starts out at 180 degrees F. and soon surrenders its heat efficiency to the cold exterior walls, such that the last room it reaches becomes the coldest room due to this, 150 feet travel distance.

This illustration spells out the inefficiency inherent in this system. Now if the reader were to focus on all the drawbacks of the forced hot air system, they would be the following. Wear and tear on the many moving parts, e.g. fans, wiring, switches. Also, too many turns in the air ducts and having to heat up all of that unnecessary space in the ducting delivery network is a complete waste of energy. Also, pollutants and allergens can fester in the air ducts causing the family respiratory problems and sickness. At this juncture, the most important drawback of both systems is the tremendous cost for either No. 2 home heating oil or natural gas. At the present time the former costs $5.50 per gallon for No. 2 home heating oil. This inventor now spends approximately $6,000 per year on No. 2 home heating oil. However, the gravest danger and drawback is that both No. 2 home heating oil and natural gas suffer from the vicissitudes of the crude oil and gas marketplace as being always vulnerable to a middle east crisis and also the whims of the OPEC cartel. Yet, the gravest existential danger emanates from the fact that both No. 2 home heating oil and natural gas are the main contributors of climate change and global warming. For example, simple math from the fact that this inventor spends $6,000 per year for No. 2 heating oil means that by dividing the price of this $5.50 cost per gallon into his annual expenditure of $6,000 conveys that he consumes 1,090 gallons of heating oil each and every year.

Thus, the gravamen of this analysis is simply that if the reader simply multiplies this 1,090 gallon capacity consumed by the 195 million single family homes in the U.S. alone, then we arrive at the staggering sum of 195,000,000,000 billion gallons of oil consumed in the U.S. each year. Now if the reader just divides the conventional figure of a typical barrel of crude oil which is a 55 gallon drum; . . . then that product yields over 3.5 billion barrels of oil consumed each year by single family homes in the USA only. Therefore, if just one 55 gallon barrel of crude oil gives off 317 kg of carbon dioxide when undergoing combustion; and the conversion of kilograms to pounds is a multiplication factor of 2.2; . . . then 697.4 lbs. of carbon dioxide times the 3.5 billion barrels yields 2.44 trillion pounds of deadly carbon dioxide is being dumped into the atmosphere from heating 195 million residential dwellings in the U.S. alone. This is ample justification for the elimination of fossil fuels to heat one's residence. Moreover, should there be any doubt in the reader's mind of the grave impact from this looming existential threat as the most compelling reason to cease using fossil fuels; therefore as of this writing on Feb. 3, 2023, the temperature in New York reached 45 degrees F. for a mid-winter month.

THE FIELD OF THIS INVENTION

The patent classification of this invention lies within D 23 which falls within the category of "Environmental Heating and Cooling". To be more specific the sub-classification of 389—"Fin Tube Radiation"; which is the ultimate subject of this invention is for a specific process which pertains to a method of heating a residential dwelling utilizing in its final phase of the delivery system a specific fluid oil medium which is subjected to an induction heating coil set up by a controlled electromagnetic field emanating off of a highly conductive metallic pipe, such as copper; thus transferring its generated heat via conduction as such, through a network of specially designed pyramidal projections on an array of aluminum fin plates and thereby raising the inherent thermomolecular kinetic heat energy to a much higher level than conventionally obtained via the customary fin tube radiation sub-class of 389.

DETAILED DESCRIPTION OF THE DRAWINGS

FIG. 1—Aerial view looking down at top HDPE compost bin cover

Figure 2:
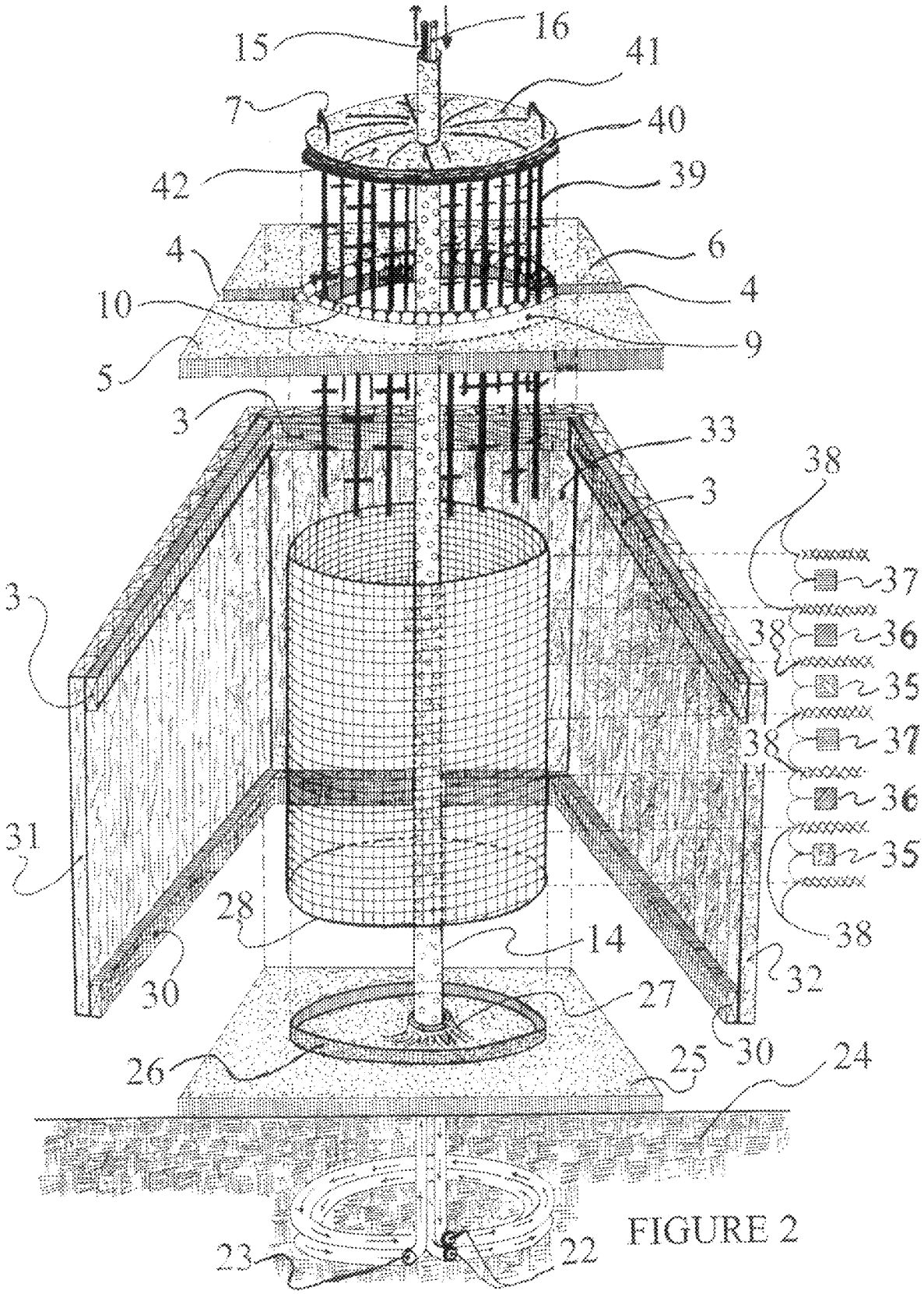

FIG. 2—Orthogonal view looking at front view of components of compost bin

FIG. 3—Schematic view of wiring diagram showing the magnetron assembly

FIG. 4—Close up view of magnetron as an electron discharging device

Figures 5, 5A, 6:
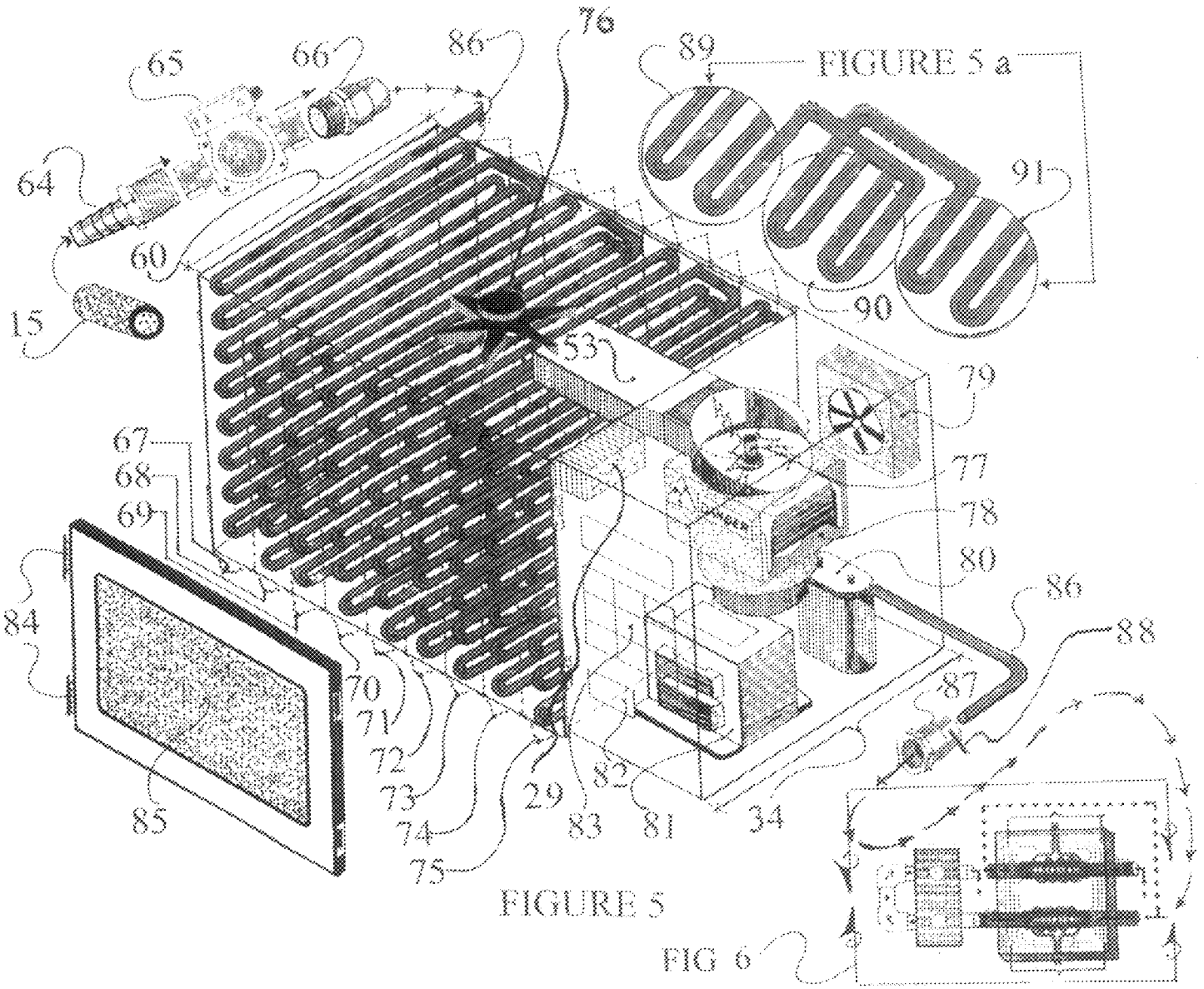
Figure 6:
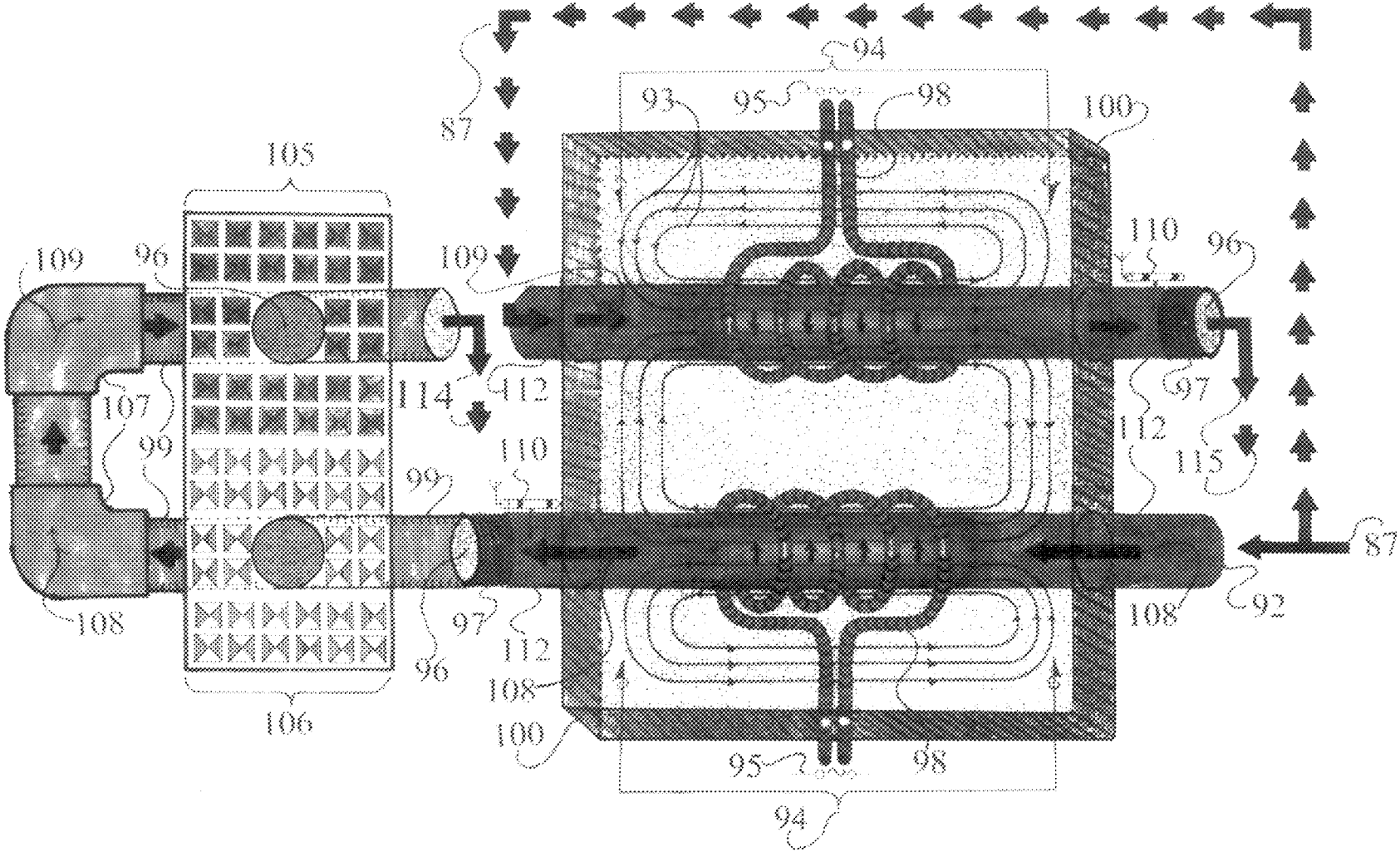
Figure 7:
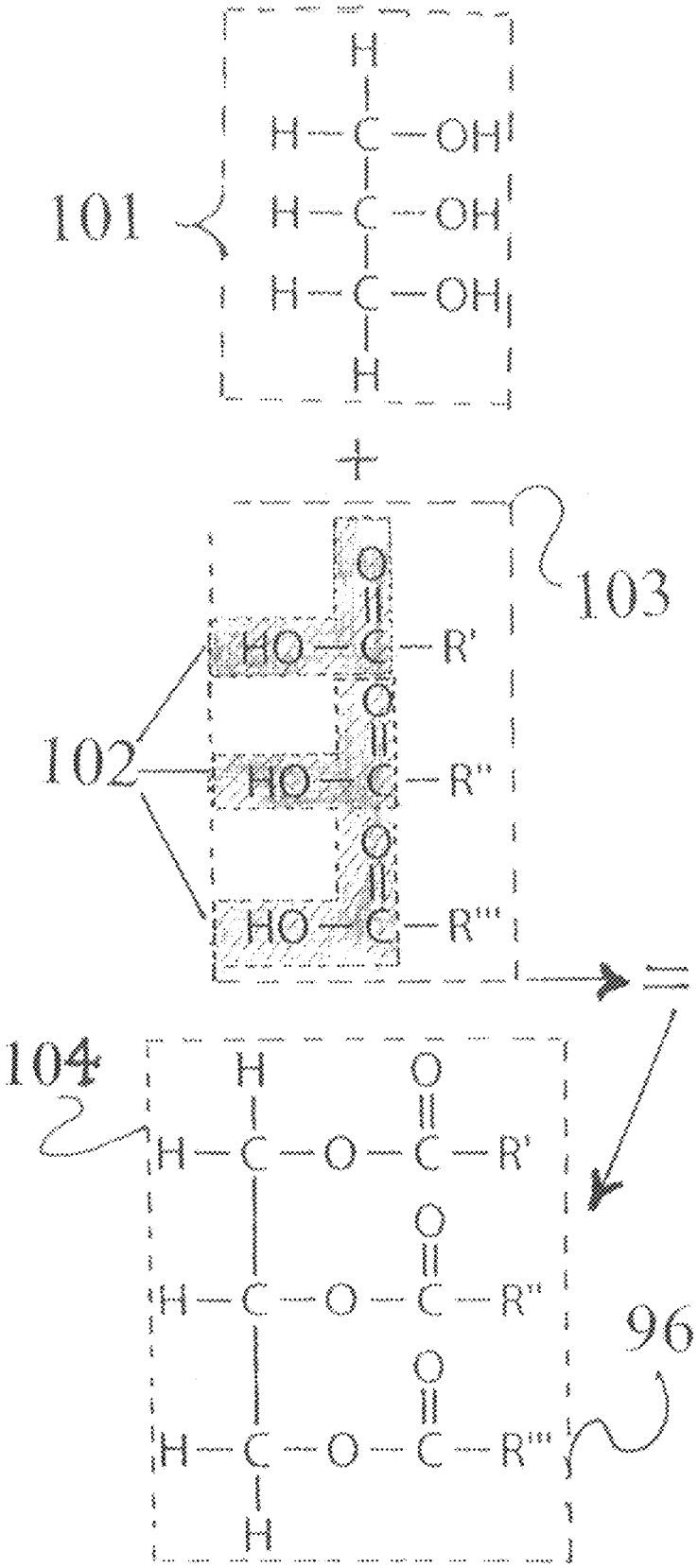

FIG. 5—Orthogonal view into the Microwave oven's essential microwave components FIG. 5 *a*—View showing horizontal transfer from one vertical row to adjoining vertical row FIG. 6—Orthogonal cross-section showing critical induction coil components FIG. 7—Structural chemical formula for polarized castor oil heating medium of Item 96

Figure 8:
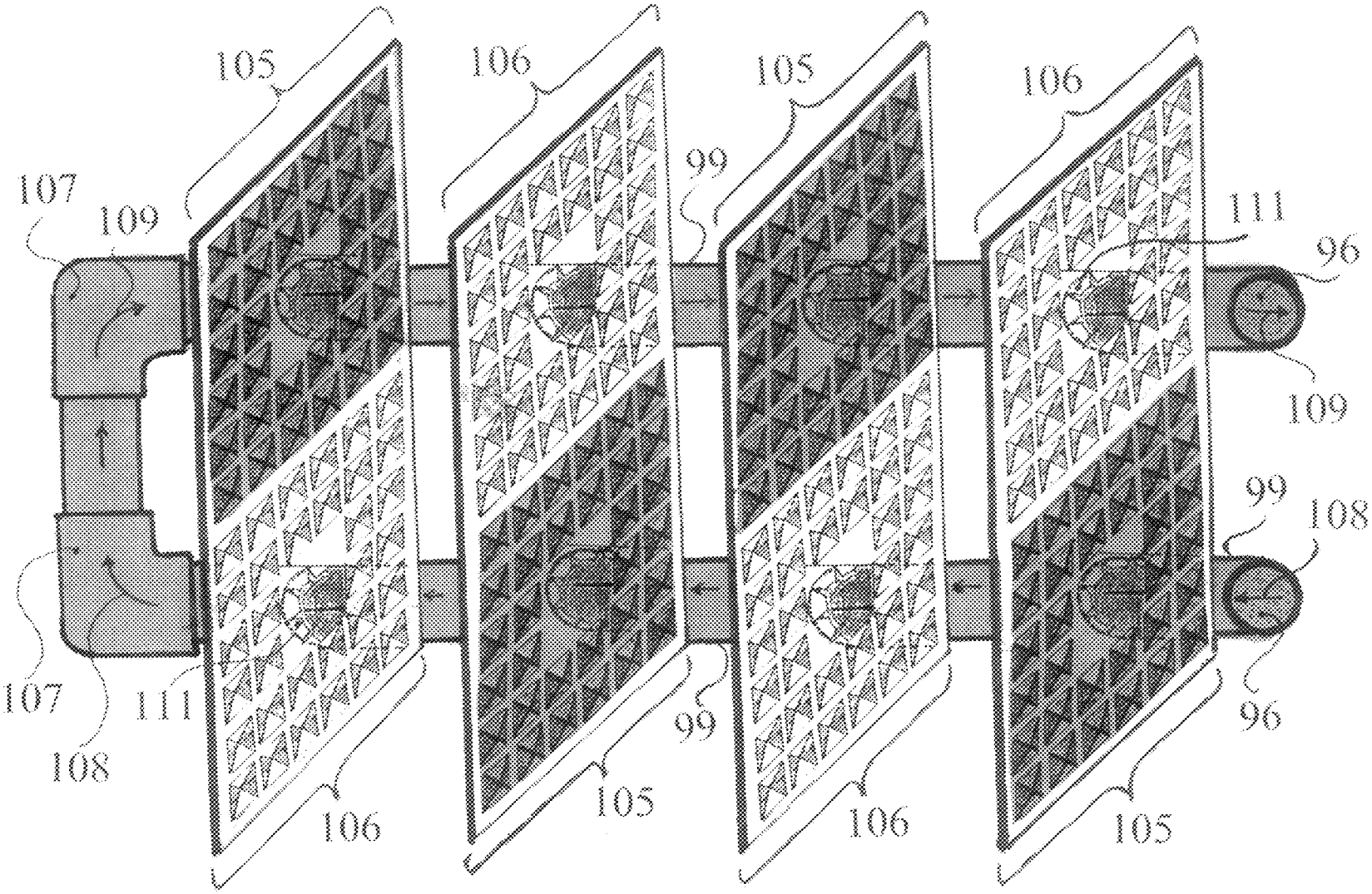
Figure 9:
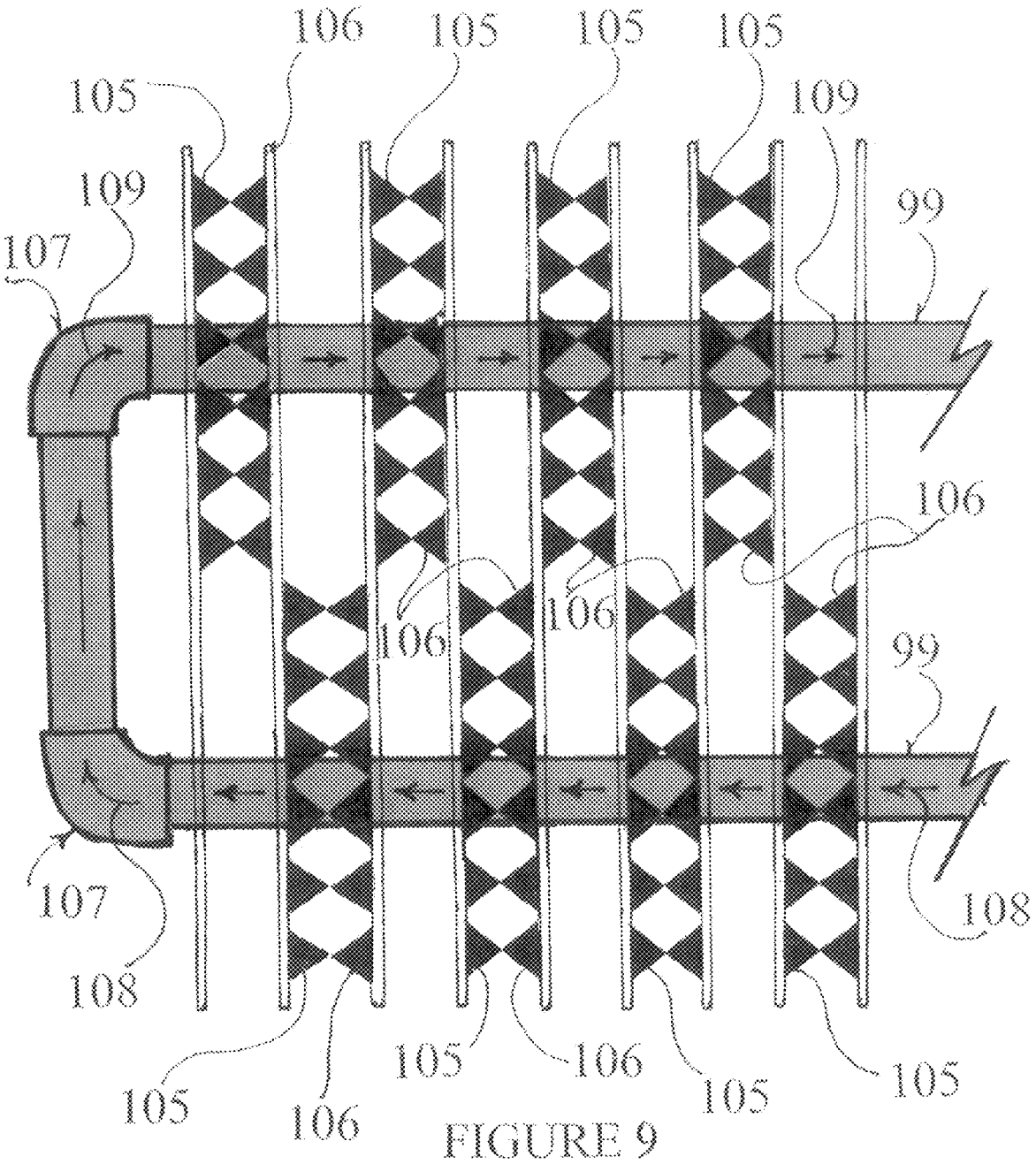
Figures 10, 10A:
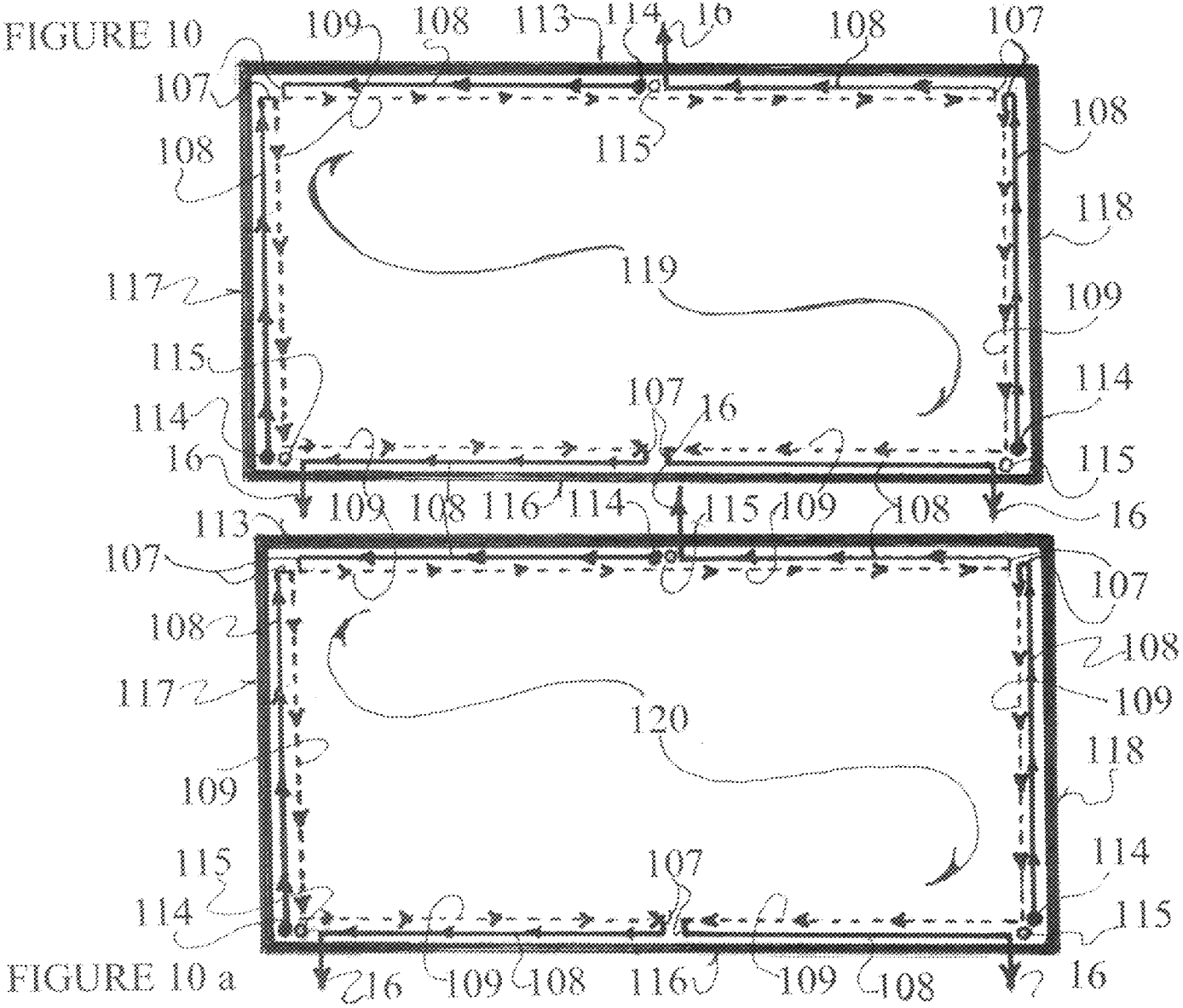

FIG. 8—Orthogonal view showing aluminum fin tubes attached to copper pipe tubing FIG. 9—Cross-section assembly view of several aluminum fin tube panels around copper pipe FIG. 10—Three major locations of piping distribution arrangement throughout the second floor FIG. 10 *a*—Three major locations of piping distribution arrangement throughout the first floor FIG. 11—Underside view looking upward beneath the pyramidal projections of Item 105 & 106

FIG. 1

Item 1—one of four HDPE sides formed to enclose lid cover over 2×4 creosote wood studs Item 2—one of many 2×4 creosote vertical wood studs forming the four perimeter outer walls Item 3—one of 4 top horizontal 2×4 creosote wood headers nailed to vertical studs of Item 2

Item 4—one of two seams at the junction of two half HDPE lid covers

Item 5—the left half portion of the HDPE compost lid cover

Item 6—the right half portion of the HDPE compost lid cover

Item 7—one of two handles to facilitate rotation and aeration of the organic compost matter Item 8—one of many holes in lid cover to provide aeration of the organic compost matter Item 9—stainless steel carriage assembly housing the ball bearings Item 10—one of the many ball bearings to facilitate rotation of the round compost lid cover Item 11—one of 15 pie shaped domed sections preformed into HDPE lid cover Item 12—one of 13 longitudinal ribbed preformed protrusions preformed into HDPE lid cover Item 13—one of many lateral aeration holes pre-drilled into the 15 pie sections of Item 11

Item 14—central PVC riser with aeration holes containing supply & return vinyl piping Item 15—⅝" vinyl reinforced flexible contractor supply heavy duty hose containing heated oil Item 16—⅝" vinyl reinforced flexible contractor return heavy duty hose containing heated oil Item 17—one of two stainless steel piano hinges for ease of assembly of PVC pipe of Item 14

Item 18—one of two stainless steel bolts through piano hinges of Item 17

Item 19—one of many steel deck screws binding horizontal header to vertical 2×4 wood walls Item 20—one of many short steel screws binding HDPE lid to vertical 2×4 perimeter walls Item 21—one of four steel angle brackets to support HDPE lid cover and also Item 9.

Item 41—the top half portion of the circular HDPE domed lid cover glued to Item #40

Item 42—the bottom half portion of the circular HDPE domed lid cover glued to Item #40

FIG. 2

Item 3—one of four top horizontal 2×4 creosote wood headers nailed to vertical studs of Item 2

Item 4—one of two seams at junction of two half HDPE lid covers

Item 5—the left half portion of the HDPE compost lid cover

Item 6—the right half portion of the HDPE compost lid cover

Item 7—one of two handles to facilitate rotation and aeration of the organic compost matter Item 9—stainless steel upright raised carriage channel assembly housing the ball bearings Item 10—one of the many ball bearings to facilitate rotation of the round compost lid cover Item 14—PVC perforated pipe with aeration holes which carries vinyl supply and return hose Item 15—⅝" vinyl reinforced flexible contractor supply heavy duty hose containing heated oil Item 16—⅝" vinyl reinforced flexible contractor return heavy duty hose containing heated oil Item 22—return tubing of polarized Castor oil heating medium coming from fin tube radiation Item 23—supply tubing of polarized Castor oil heating medium going to microwave oven Item 24—disturbed soil to install #15 & #16 supply and return hoses with ground at 56 degrees Item 25—pre-formed HDPE base platform floor for perimeter compost bin wall assembly Item 26—preformed HDPE circular ring to attach #28 round wire mesh enclosing organic waste Item 27—preformed HDPE raised annulus housing to accept perforated PVC pipe of Item #14

Item 28—9 gauge 1½" square chain-link circular compost cage covered with fine wire mesh Item 30—one of four horizontal 2×4 creosote wooden toe nailers to secure four perimeter walls Item 31—one of several 2×4 creosote vertical wood studs forming the left wall Item 32—one of several 2×4 creosote vertical wood studs forming the right wall Item 33—one of several 2×4 creosote vertical wood studs forming the rear wall Item 35—4 inch compost layer of straw, corn stalks, and twigs within the cage of Item #28

Item 36—4 inch compost layer of dry leaves and newspapers within the cage of Item #28

Item 37—4 inch compost layer of grass clippings within the cage of Item #28

Item 38—alternating interspersed thin layers of worms, nematodes and vermicules in Item #28

Item 39—one of several steel dowels screwed into welded steel couplings under lid cover Item 40—12—gauge bottom of lid cover assembly Item 41—the top half portion of the circular HDPE domed lid cover glued to Item #40

Item 42—the bottom half portion of the circular HDPE domed lid cover glued to Item #40

FIG. 3

Item 43—primary winding from external 120 volt outlet from household electric current Item 44—step-up transformer which raises voltage from primary wiring of Item 43

Item 45—secondary winding from the transformer which delivers high voltage to the magnetron Item 46—one of two electron discharge devices as magnetrons within the microwave oven Item 47—one of two coaxial transmission lines from magnetron #46 to wave guide #53

Item 48—one of two coaxial transmission lines from magnetron #46 to wave guide #53

Item 49—one of 2 wire leads which connect to opposite terminals of secondary winding of #45

Item 50—one of 2 wire leads which connect to opposite terminals of secondary winding of #45

Item 51—one of two outlet coupling loops to transmit magnetic wave oscillations to wave guide Item 52—one of two outlet coupling loops to transmit magnetic wave oscillations to wave guide Item 53—common hollow wave guide within microwave compartment; disperses micro waves Item 54—copper anode block consisting as an evacuated envelope with 8 evacuation chambers Item 55—one of eight resonant cavities as evacuation vanes within anode block of Item #54

Item 56—mid common high voltage wire feeding two separate conductor wires of #57 & #58

Item 57—one of two separate high voltage connector wires to central cathode of Item #59

Item 58—one of two separate high voltage connector wires to central cathode of Item #59

Item 59—highly electron-emissive oxide coated cathode centrally located (one of two)

Item 60—the heating compartment of the microwave oven containing 9 vertical PVC loops

FIG. 4

Item 52—one of 2 coupling loops to transmit magnetic wave oscillations to wave guide of #53

Item 54—copper anode block consisting as evacuated envelope with 8 hollow vanes of Item #55

Item 59—highly electron-emissive circular oxide coated cathode centrally located (one of two)

Item 55—one of eight resonant cavities as evacuation vanes within anode block of Item #54

Item 61—wire leads of Item #57 and Item #58 activates the cathode to produce microwaves Item 62—dotted circular wave-like oscillating and spinning electrical magnetic induced field Item 63—curved oscillating circular path of the magnetic field which shoot electrons at Item #52

FIG. 5

Item 15—⅝" vinyl reinforced flexible supply heavy hose which has heated oil from compost bin Item 34—the microwave compartment containing all of the oven's critical working parts Item 53—common hollow wave guide within microwave compartment; disperses micro waves Item 64—barbed fitting connects supply hose Item #15 via pipe thread to circulator pump #65

Item 65—circulator pump which establishes the flow rate of the polarized Castor heating oil Item 66—PVC fitting connects circulator pump to PVC pipe supply line filled with oil Item 67—First vertical row of nine PVC supply loops in microwave heating compartment #60

Item 68—Second vertical row of nine PVC supply loops in microwave heating compartment #60

Item 69—Third vertical row of nine PVC supply loops in microwave heating compartment #60

Item 70—Fourth vertical row of nine PVC supply loops in microwave heating compartment #60

Item 71—Fifth vertical row of nine PVC supply loops in microwave heating compartment #60

Item 72—Sixth vertical row of nine PVC supply loops in microwave heating compartment #60

Item 73—Seventh vertical row of nine PVC supply loops in microwave heating compartment #60

Item 74—Eight vertical row of nine PVC supply loops in microwave heating compartment #60

Item 75—Ninth vertical row of nine PVC supply loops in microwave heating compartment #60

Item 76—Wave stirrer which circulates the microwaves throughout compartment Item #60

Item 77—antenna (microwave emitter) which emits microwaves into wave guide Item #53

Item 78—Main magnetron as the electron emitting device which contains two of Item #46

Item 79—cooling fan which cools down the microwave heating compartment of Item #60

Item 80—the capacitor as a device for storing electrical energy and consists of two conductors Item 81—high voltage transformer contains Items #43; Item #44; and Item #45 of FIG. 3

Item 82—door release button for access to heating compartment of Item #60

Item 83—control panel allows use of a remote control device to adjust microwave energy level Item 84—door hinge which allows the door to swing open and pivot close shut Item 85—metal mesh window prevents the escape of errant harmful microwaves Item 86—½" PVC supply tubing leaves microwave heating section to Induction Coil Item #100

Item 87—fitting connects #86 to ¾" pipe (an increase in pipe size) which slows flow rate Item 88—the thermocouple which monitors remotely the temperature of oil medium Item #96

FIG. 5 *a*

Item 89—first vertical row of supply PVC tubing connects to second vertical row at top of oven Item 90—second vertical row of PVC tubing connects to third vertical row at bottom of oven Item 91—third vertical row receives supply PVC tubing at bottom of oven

FIG. 6

Item 87—oil medium supply flow coming from attic microwave oven to the 2$^{nd}$ & 1st floors Item 92—¾" supply ferrous pipe containing oil flow coming from microwave oven Item #87

Item 93—electromagnetic eddy current forces of heat energy produced from induction coil #98

Item 94—the area of coverage of heated electromagnetic energy field in glass ceramic housing Item 95—the household AC electric current which energizes the induction coil assembly #98

Item 96—the heated oil medium heated within the ferrous iron pipe temperature 230 degrees F.

Item 97—the ferrous pipe thread which connects to "K" rigid fin tube radiation copper pipe Item 98—metallic electromagnetic induction heating coil wrapped around the ferrous iron pipe Item 99—the ¾" rigid copper pipe which holds all of the pyramidal fin tube radiation assembly Item 100—Pyroceramic enclosure insulating material which houses induction coil and iron pipe Item 105—aluminum upper fin tube assembly with pyramidal projections jutting out to reader Item 106—aluminum lower fin tube assembly with pyramidal projections jutting away reader Item 107—the 90 degree rigid copper elbow attaching the supply to return fin tube assembly Item 108—flow of direction of supply polarized Castor oil heated fluid medium on bottom tier Item 109—flow of direction of return polarized Castor oil heated fluid medium on top tier Item 110—the radio transistor with antennae and thermocouple inserted into ferrous pipe Item 112—the ¾" black ferrous iron pipe with induction coil assembly containing the hot oil Item 114—the terminal end of aluminum fin tube baseboard which leaves attic to 2$^{nd}$ floor Item 115—the terminal end of aluminum fin tube baseboard which leaves attic to 1st floor

FIG. 7

Item 101—the glycerol molecule containing three negatively charged hydroxyl groups —OH Item 102—the three negatively charged carboxyl groups within the fatty acids Item 103—the three fatty acid molecules with their polarized negatively charged carboxyl groups Item 104—chemical structural formula of triglyceride (mineral oil) made from #102 and #101

Item 96—the fluid oil medium of triglyceride which is identical to Item #104 above

FIG. 8

Item 99—the ¾" rigid copper pipe which holds all of the pyramidal fin tube radiation assembly Item 105—aluminum fin tube panel with pyramidal projections jutting out toward the reader Item 106—aluminum fin tube panel with pyramidal projections jutting away from the reader Item 107—the 90 degree rigid copper elbow attaching the supply to return fin tube assembly Item 108—flow of direction of supply polarized Castor oil heated fluid medium on bottom tier Item 109—flow of direction of return polarized Castor oil heated fluid medium on top tier Item 111—aluminum punched out tabs soldered to copper pipe

FIG. 9

Item 99—the ¾" rigid copper pipe which holds all of the pyramidal fin tube radiation assembly Item 105—aluminum fin tube panel with pyramidal projections jutting out toward the reader Item 106—aluminum fin tube panel with pyramidal projections jutting away from the reader Item 107—the 90 degree rigid copper elbow attaching the supply to return fin tube assembly Item 108—flow of direction of supply polarized Castor oil heated fluid medium on bottom tier Item 109—flow of direction of return polarized Castor oil heated fluid medium on top tier

FIG. 10

Item 16—⅝" vinyl reinforced flexible contractor return heavy duty hose with heated oil #96

Item 107—the 90 degree rigid copper elbow attaching the supply to return fin tube assembly Item 108—flow of direction of supply polarized Castor oil heated fluid medium on bottom tier Item 109—flow of direction of return polarized Castor oil heated fluid medium on top tier Item 113—the entire length of the rear portion of the dwelling Item 114—descending riser coming from induction coil assembly in the attic to $2^{nd}$ floor below Item 115—descending riser coming from the induction coil assembly in attic to $1^{st}$ floor below Item 116—the entire length of the front portion of the dwelling Item 117—the entire length of the left side portion of the dwelling Item 118—the entire length of the right side portion of the dwelling Item 119—the entire second floor layout of the dwelling FIG. 10 *a*

Item 16—⅝" vinyl reinforced flexible contractor return heavy duty hose with heated oil #96

Item 107—the 90 degree rigid copper elbow attaching the supply to return fin tube assembly Item 108—flow of direction of supply polarized Castor oil heated fluid medium on bottom tier Item 109—flow of direction of return polarized Castor oil heated fluid medium on top tier Item 113—the entire length of the rear portion of the dwelling Item 114—descending riser coming from the induction coil assembly in the attic to floors below Item 115—descending riser coming from the induction coil assembly in the attic to $1^{st}$ floor Item 116—the entire length of the front portion of the dwelling on the first floor Item 117—the entire length of the left side portion of the dwelling on the first floor Item 118—the entire length of the right side portion of the dwelling on the first floor Item 120—the entire first floor layout of the dwelling

FIG. 11

Item 105—aluminum fin tube panel with pyramidal projections jutting out toward the reader Item 106—aluminum fin tube panel with pyramidal projections jutting away from the reader Item 122—the sloping pyramids of Item 105 and Item 106 which block passage of air Item 123—the escape passageway which allows the circulating air currents to rise upward

DETAILED DESCRIPTION OF THIS INVENTIVE PROCESS

First Embodiment

The inventive novelty surrounding this utility patent application is for a three step process which constitutes a series of actions or steps taken by a typical homeowner in order to achieve two fundamentally important outcomes. First is to generate warm home heating comfort for his dwelling while secondarily at the same time saving thousands of dollars from not having to pay for costly fossil fuel expense as the usual and customary means of expenditure for heating one's home. The first initial step toward this tangible First Embodiment of this inventive process is to transform useless organic municipal waste refuse, such as yard trimmings, grass clippings, kitchen and food scraps, dead leaves, newspaper clippings which collectively are normally destined for the municipal landfill; and instead, composting this same garbage waste material within a specially designed composting bin and cleverly extracting the most valuable by-product from this natural decomposition process; . . . which is FREE heat energy; . . . thereby being generated within this composting bin; without any cost whatsoever.

While composting per se is not novel, however, bringing its by-product of heat generation into the interior of a residential dwelling for comfort is certainly novel. Accordingly, the homeowner first begins by digging a hollow four-foot long×four-foot wide×four-foot deep hole in his backyard in close proximity to the dwelling's exterior wall. Next is a perimeter arrangement of vertically aligned creosote pressure treated 2×4 wood studs shown in FIG. 1 as Item #2. These vertical walls are erected on all four sides of the 4'×4'×4' cube as shown with the "X" configuration depicted therein on each stud. The latter are secured at the very top by four Item #3—2×4 creosote pressure treated headers and screwed in place with Item #19 which is a steel construction screw. These vertical walls are also secured at the very bottom of the 2×4 wood studs as shown in FIG. 2 as Item #30.

However, before the composting bin is inserted into said 4'×4'×4' dug-out cubelike hole; a shallow pit is dug beneath the earthen floor within the location as shown by FIG. 2 Item #24 which is the undisturbed virgin soil immediately beneath this composting bin. Into said shallow pit is deposited Item #23 and Item #22; which is the vinyl flexible ⅝" contractor's supply and return hose which constitutes the process's starting point and which traverses into the "PVC (Polyvinyl chloride) perforated vertical pipe shown as Item #14. Said latter pipe is secured into its pre-formed "HDPE (high-Density Polyethylene)" raised annulus of Item #27 which is formed during the bin's manufacture into the floor platform base structure. Appropriately, only three of the four perimeter walls are shown graphically as Item #31; which is the left wall, as well as Item #32; which is the right wall, and Item #33; which is the rear wall. Also the supply and return flexible vinyl ⅝" contractor's heavy duty hose are also shown in FIGS. 1 and 2 as Items #15 and Item #16. FIGS. 1 and 2 also show the two top halves of the HDPE lid cover depicted as Item #5, . . . which is the left half; and Item #6, which is the right half.

Chief among the several design features of this top lid cover is the security it affords the homeowner from the invasion of animals and rodent pests in their quest for foraging for food material. This security is enhanced via the four-sided box-like lid cover of Item #1 screwed into the top portion of the vertical 2×4 wood studs via many of Item #20 which are the short steel screws. Normally, Item #1 would suffice to support each half "HDPE (high-Density Polyethylene) lid assembly; however, there is the necessity of required additional support for the heavy steel circular lid cover; . . . which is formed by a top plastic "HDPE (high-Density Polyethylene) portion incorporating many pre-formed design features and a glued on bottom 12 gauge galvanized steel portion shown as Item #40—FIG. 2; which is made into two halves and joined by two Item #17 piano hinges engaged together via the two steel bolts shown as Item #18. The entire inner circumferential perimeter of this "HDPE (high-Density Polyethylene) two portion lid assembly of Items #5 and Items #6 are circumscribed with a specially designed ball bearing assembly shown as Item #9—FIG. 2. Therefore, in order to support this latter weight of the ball bearing assembly; and also the weight of the collective 12 gauge steel lid cover of Item #40, . . . are four steel brackets shown as Item #21—FIG. 1.

For clarity the reader must notice that the two seams in the "HDPE (high-Density Polyethylene) half covers are shown as Items #4—FIG. 1. It is also noteworthy to point out that the process of composting requires several indispensable necessities. Chief among these necessary vital inclusions would be the provisions for aeration; irrigation with water and rotation of the organic composting material. The following design features satisfy these requirements.

Item #8—FIG. 1 are the many numerous holes in the two halves of the "HDPE (high-Density Polyethylene) lid assembly of Items #41 and Items 42. These latter design features allow the entry of natural air and water into the composting heap as well the holes in the PVC perforated pipe of Item #14. Accordingly, the circular lid cover also has numerous aeration holes which also function as irrigation holes as follows. Those holes are shown as Item #13. The reader must now focus on the specially designed thirteen raised longitudinal raised protrusions which are radially disposed as Item #12; which latter design features work in tandem with Item #11; . . . shown as the pre-formed dome shaped pie segments comprising the entire surface of the circular lid cover. Hence, as the rainwater hits the lid cover, the raised dome surface of Item #11 normally sheds the water laterally to each pie's flank side, which logically stops the water at every longitudinal Item #12, and thus forces this pooling water to enter into every aeration aperture of Item #13.

As mentioned previously, the ball bearing carriage assembly of Item #9 contains end to end steel ball bearings ensconced in axel grease. The ball bearings are shown as Item #10. The two handles of Item #7 facilitate the rotation of the lid cover over the pin point contact of the ball bearings; which helps shuffle and rotate the organic matter within the compost heap. The missing description of just how this organic material is housed and contained within the confines of the compost heap is as follows. Item #28 is a 9 gauge chain link wire fence material with square boxes each measuring 1½" square and formed and joined as a complete open ended hollow cylinder. The bottom portion fits snugly into the pre-formed circular retention raised ring of Item #26. The top of the chain link wire cage fits snugly into Item #9 which is the "HDPE (high-Density Polyethylene) pre-formed groove of the stainless-steel carriage assembly which houses the ball bearings. As previously mentioned the chain link wire cage has 1½" squares which will not suffice to contain the small organic material mentioned at the top of page 13. Hence, a further accoutrement to prevent this loss of organic composting waste material is a fine steel wire mesh outer screen which completely surrounds the chain link wire cage. (not graphically drawn for clarity sake)

The necessity for rotation is accomplished as follows. Aeration and decomposition is not complete until every centimeter of organic material become imbued with fresh air and oxygen. Hence, this aeration is achieved by proper mixing and rotation of this organic material. Perhaps the best method for incorporating more air into the compost heap is to turn the compost pile completely several times daily. Therefore, Item #39 which are the steel dowels screwed into the welded pipe couplings located on the underside of Item #40 act as aerating cranks, especially in conjunction with its random oriented and staggered welded cross splines graphically depicted in FIG. 2.

At this juncture the reader now becomes familiar with the composting science of incorporating a good mix of yard waste, such as pruned branches, spent plants, dead flowers, tea bags, coffee grains, grass clippings, twigs, leaves, and weeds. Next comes wood chips and sawdust. In short, sources of carbon and nitrogen; i.e. three parts brown stuff to one-part green stuff. Please peruse the past examples; some stuff is green naturally; while the rest is brown naturally. Shredded newspaper is also welcome. The reader is also now encouraged to view Items #35 and Items #36, and Items #37 which are each layered organic material deposited as being piled four inches high within the confines of the compost cage of Item #28. Furthermore, it is exceedingly important for the homeowner to recognize that each of these foregoing alternating four-inch layers of organic matter must be interspersed with soil worms or other various invertebrates, which in layman's parlance are worms lacking backbones; shown as tiny "x" shaped cross-hatching; . . . Item #38—FIG. 2. These worms are the quintessential ingredient from which their inherent bacterial enzymatic activity results in the physical decomposition process producing the desired end result of heating up the entire compost heap or cage; . . . thereby causing the ambient temperature therein to rise within this composting bin.

Adding more knowledge base to this marvelous world of worms, lets first consider the primary consumers which feed on the organic material only. This is bacteria such as actinomycetes, fungi, protozoa, nematodes, sowbugs (wood lice) pillbugs, millipedes, slugs and snails. Next come the secondary consumers which eat up and feed on the primary consumers. These are spring tails, beetles, mites, nematodes, and protozoa. Finally, there are the tertiary consumers which feed upon the secondary consumers and these are your centipedes, predatory mites, and beetles. Also lets not forget ants, flies and earthworms. Unquestionably therefore, it is these worms and other invertebrates which produce the necessary FREE heat to initially warm the homeowner's residential interior dwelling. The reader must also become aware that the return vinyl hose at the level of the lid cover shown in FIG. 1 as Item #16, on its descent to the bottom of the compost heap travels through an ambient temperature of between 105 degrees F. to 165 degrees F. throughout this composting bin; especially through Item #28 which is a four foot travel through this FREE high ambient heat. Please recognize that Item #16 as a return line travels downward as coming from the attic within said dwelling which passively picks up this free compost heat.

More importantly, since it is contained within a closed loop; . . . at the very bottom upon its reverse upward travel or ascent, it thus becomes automatically Item #22 as it culminates its final end terminal point of the return vinyl hose. Therefore, it now rises upward and soon becomes Item #23 which is the supply vinyl hose and so once again it begins to travel through this 105 degree F. to 165 degree F. FREE heat temperature of the compost heap through another four feet of HOT organic decomposed compost material. Just an explanatory note is needed here to elucidate that when the supply vinyl hose of Item #15 leaves the hot temperature environment within the composting cage of Item #28, it is thereafter furnished with trace heating cables which provides freeze protection and ensures that the necessary 105 degree F. to 165 degree F. temperature maintenance integrity is kept intact until it enters the building under the warm confines of that dwelling during the cold months of winter. Further, this specification must guide the reader into an understanding that in some states within the United states this 105 degree F. to 165 degree F. temperature generated FREE by the composting heat may just suffice by itself alone without the second and third embodiment of this inventive process being needed. Therefore, the inventor has prepared a table of every state in alphabetical order by indicating within its adjoining box the lowest temperature experienced within each particular state during the winter months shown as the lowest degree of temperature in Fahrenheit. Hence, only the thermostat setting within the dwelling can ascertain whether the home owner needs the second embodiment of this inventive process as Step 2.

LOWEST INDIVIDUAL TEMPERATURE BY STATE

| | | | | | | | | | |
|---|---|---|---|---|---|---|---|---|---|
| AK | 13 | HI | 68 | ME | 15 | NJ | 26 | SD | 17 |
| AL | 19 | IA | 15 | MI | 17 | NM | −50 | TN | 49 |
| AR | 58 | ID | 24 | MN | 9 | NV | 40 | TX | 39 |
| AZ | 45 | IL | 48 | MO | 25 | NY | 29 | UT | 17 |
| CA | 40 | IN | 21 | MS | 25 | OH | 21 | VA | 25 |
| CO | 22 | KS | 24 | MT | 12 | OK | 58 | VT | 12 |
| CT | 21 | KY | 28 | NC | 50 | OR | 36 | WA | 37 |
| DE | 32 | LA | 41 | ND | 37 | PA | 26 | WI | 40 |
| FL | 41 | MA | 23 | NE | 16 | RI | 48 | WV | 33 |
| GA | 35 | MD | 25 | NH | 9 | SC | 42 | WY | 27 |

It can clearly be shown that there are only three states, Arkansas, Oklahoma and Hawaii which do not need the benefit of the second and third embodiment for heating the interior of the dwelling within those states during the winter months. The reader will also find comfort in the fact that the State of California recently promulgated into a groundbreaking new law, known as Senate Bill 1383; which mandates that all homeowners within that state must now change how they dispose of their organic waste; particularly leftover food and kitchen scraps. In sum and substance, the state of California now requires that their citizens compost organic unwanted refuse matter. Understandably, if this is the law, then it behooves these citizens to go the extra mile and extract the FREE heat. The good news is that other states will soon follow suit. Thus, the reader is now encouraged to download and Google the article entitled; . . . "What you need to know about California's new composting law . . . a game changer for food waste."

Second Embodiment

Before we begin our discussion of Step 2 it is exceedingly instructive to convey to the reader just how the separate three embodiments are oriented within the dwelling of the homeowner. Therefore, we must begin by explaining that the typical and customary single-family dwelling in the U. S. on average measures approximately 50 feet long by 26 feet wide and is usually two stories high (i.e. two floors). Hence, it is theorized that for this dwelling size, three compost bins are needed. Two compost bins will be dug at the two sides of the house at the very front corner. The third one will be buried at the center of the backside of the house. There will then be required three separate microwave ovens; i.e. Item #60 to service each separate floor coming off the same compost bin. Now it is also assumed that these three microwave ovens will either be located in the attic or perhaps a linen closet, thence from there, traversing through the clothes closets to an exterior wall to provide the heat required at that exterior wall; . . . understandably in the same manner as a conventional hot water baseboard hydronic heating system is set up along the floor of an exterior wall. Now it should be fully understood that when the compost bin's supply tubing of Item #15 enters the building, it is for the most part ⅝" vinyl contractor's heavy-duty flexible hose, therefore, the hot castor oil from the compost bin of FIG. 2 begins its journey by urging the reader to now peruse FIG. 5.

Item #15 is the continuation from Step #1 and also begins the process and journey for Step #2. Next the barbed end of Item #64 gets clamped to this Item #15, while the ½" pipe thread of Item #64 screws into the input end of the circulator pump of Item #65. Afterward, the ½" pipe thread of Item #66 screws into the output end of the same circulator pump of Item #65. The other end of Item #66 is a female connection which receives ½" "PVC (Polyvinyl chloride) pipe which gets glued into the supply "PVC (Polyvinyl chloride) pipe end of Item #86 which now enters the heating compartment of Item #60 of the microwave oven. It is helpful for the reader to fully understand just how a typical microwave oven works in a kitchen used to heat and warm food stuffs. There is a rotating turntable tray which rotates the food sought to be heated, thus insuring that all of the foods particles are heated uniformly. It is noteworthy here to mention that this rotational feat is impossible for our inventive process. The reason for the former explanation of the rotating tray with foodstuff is because these heating microwaves are sine waves of about four inches long and thus the rotating tray would insure that every bit of the foodstuff receives this heat energy.

However, this inventive process solves this impossible rotational problem as follows.

Accordingly, to solve this rotational problem the "PVC (Polyvinyl chloride) tubing traverses into an array of nine vertical rows; by first coursing downward (note the direction of arrows in FIG. 5) in Row 1 as Item #67; thence upward in Row 2 as Item #68; . . . followed by a downward travel in Row 3 as Item #69 and thus alternating in repetitive fashion up and down while the heated oil circulates because of the flow rate being produced by the circulator pump of Item #65.

In essence, every molecule of castor oil is heated in this manner. Row #4 as Item #70 flows upward; while Row #5 as Item #71 thus flows downward. Next, Row #6 as Item #72 flows upward; while Row 7 or Item #73 flows downward. In the same manner, Row #8 or Item #74 flows upward; while Row #9 or Item #75 flows downward; . . . which we can all appreciate is quite convenient because this end run supply tubing of Item #86 exits in the rear of the heating compartment as shown on the bottom right of FIG. 5. Item #86 the supply PVC tubing with the hot polar castor oil connects and is glued into the "PVC (Polyvinyl chloride) end of Item #87 at one end of this fitting while the opposite end is connected as ¾" pipe thread and screwed into the fitting of Item #87. This latter item at one end receives the ¾" pipe thread from Item #87; while the front end of this latter fitting connects to the ½" "PVC (Polyvinyl chloride) back end of Item #86 from the microwave, all of which then enters into the induction coil assembly of FIG. 6, as shown therein.

It is important to point out that whereas the entering diameter of the supply tubing of FIG. 5 shown as Item #86 begins with ½" diameter "PVC (Polyvinyl chloride) tubing; however, when it enters the iron pipe at Item #87, said diameter now increases to ¾" pipe; . . . therefore, the science of fluid mechanics dictates that this fact is important because the rate of flow now decreases; thus more heat is being transferred via conduction. Now let's turn to FIG. 5*a* in order to impart a thorough understanding of just how this oil medium flows in the heating compartment of Item #60. Item #89 shown is the exact equivalent as the first vertical row of Item #67. As mentioned previously, this flow is downward where it enters at the very top of the heating compartment of Item #60 and is shown as Item #86. Here, in both Item #67 and Item #89 (both identical items) the oil flows vertically in a downward direction. In other words, it enters the rear at the very top, then flows toward the front where that elbow fitting then sends it backward within the next lower vertical tier toward the rear of the heating compartment of Item #60. Thereafter, the next ensuing elbow then directs the flow forward thus coursing toward the front, and so on and so forth; repetitively in a similar back and forth progress until the flow at the very last vertical row at the very bottom; . . . when it reaches the rear aspect of the heating compartment of Item #60 it suddenly changes instead to a horizontal direction at the very rear and thus transfers its flow from this horizontal direction to a now vertical flow upward direction as shown via Item #68; . . . which is the second vertical row identical with Item #90 of FIG. 5*a*. (Hence, both Item #68 and Item #90 are identical items)

Therefore, the flow within Item #90, from the rear of Item #60 continues progressing back and forth upward all along the second vertical row until it reaches the very top vertical aspect of Row #2 whereupon it now suddenly changes direction horizontally and begins to traverse over to the third vertical row of Item #91 (which is the exact equal equivalent of Item #69) and now progresses in a downward direction. The reader must realize that this is how the heating microwaves will be guaranteed to heat every single molecule of oil. It is instructive at this juncture to simply introduce the reader to the critical components contained within the parts compartment of the microwave oven shown as Item #34. It should be understood that the microwave is capable of producing excessive heat above 150 degrees F. and so precaution dictates that a cooling fan is necessary to cool the oven down as shown via Item #79. Item #77 is the antennae which emits the microwaves. Item #78 figuratively is the quintessential heart, brains and muscle of the microwave oven which produces the desired heat in the form of microwaves. This item will be further explained in detail shortly. The wave guide of Item #53 guides the microwaves into the central interior compartment of the heating compartment shown as Item #60; while Item #76 the wave stirrer oscillates the sine waves of the four-inch long microwaves. Item #80 is the capacitor which creates and stores large amounts of electricity which serves to step up the power to the magnetron of Item #78. The standard 120 Volts power in the typical residential household is not sufficient to drive the magnetron which needs at least 1000 volts to operate efficiently. In the next phase, when the voltage of the high voltage winding (see Item #45 FIG. 3) is negative, that secondary winding and the charged capacitor of Item #80 are connected in series, thus delivering double the peak voltage to the magnetron. Item #81 is the high transformer (also shown as Item #44 FIG. 3. Please note that FIG. 3 is purely an electrical schematic representation.

Item #83 is the control panel which allows a remote control to select variable power which is a range of power or levels of wattage of heat such as warm, low, medium low, medium, medium high and high. Item #82 is the door release button for access to service the interior components. Item #84 are the door hinges. Item #85 is the metal mesh glass window for viewing while preventing errant microwaves from escaping out of control into the home. As mentioned earlier Item #78 the magnetron is the quintessential heat generating device and the electrical schematic shown in FIG. 3 which is important to convey to the reader how fossil fuel expenditure can be obviated by using ordinary household current of 120 volts to sustain a level of heat energy sufficient enough to heat a 2,600 square foot home to a comfortable level of 72 degrees F. during the winter months when its 20 degrees F. outside. Hence, we begin within FIG. 3 with the conventional plug-in electrical outlet of Item #43 (the household current of 110 volts AC) which the microwave oven appliance plugs into. (this is shown as the primary winding) Item #44 (which is also Item #81 of FIG. 5) is the high voltage step-up transformer which raises the voltage on the secondary winding of Item #45 to a high voltage of 1000 volts. It is exceedingly necessary to compare both FIG. 3 alongside with FIG. 4; because items within the former are identical with the same item within the latter.

For example, Item #56 within FIG. 3 is the common high voltage wire coming off of the secondary winding of the high voltage transformer carrying 1000 volts or more. This common high voltage wire branches off into two separate high voltage connectors which end up into the negative cathode centrally located within the magnetron core of Item #78. These two separate high voltage branches are shown as Item #57 and Item #58 respectively within FIG. 3. Now if the reader views FIG. 4, those same high voltage connections are shown as Item #61 which enters the central circular cathode depicted as Item #59 within both FIGS. 3 and 4.

This electrical lead produces the negative connection for completion of the electrical circuit load and are shown as Item #49 and Item #50 within FIG. 3 as coming from the secondary winding of the transformer. Please take notice that they (Item 49 and Item 50) both terminate within the center of the positively charged anode or Item #55. In other words, from the high voltage secondary winding of 1000 volts from Item #45 there are two end terminal wires coming off it as Item 49 and Item 50; which both feed into this positively charged Item #55 as one of the eight resonating cavities of Item #55 and the lone central common feed wire of Item #56 which enters Item 59 as the circular central cathode which is negatively charged. Additionally, the viewer or reader is encouraged to refer to Item #52 within FIG. 4 which is the enlarged depiction of this positive terminus within Item #55. It is at this positive terminus where the two separate output loops shown as Item #51 and Item #52 within FIG. 3 and FIG. 4 which generate and transmit their respective magnetic wave oscillations in the form of sine waves or microwaves; . . . each one vibrating violently from this thermomolecular excitation and thereby emitting the desired heat energy in the form of microwaves.

These microwaves next travel via co-axial transmission lines shown as Items #47 and Items #48—FIG. 3 respectively. Thereafter, they both then travel toward and enter the wave guide shown as Item #53; . . . wherein this latter device distributes the microwaves into the center of the microwave heating compartment shown as Item #60. Please notice that both of these two electron discharging devices known as the magnetrons are shown graphically as Item #46 therein; constitute the entire magnetic core consisting of the positively charged anode; which is also known as the resonating cavity shown as Item #55 as drawn within FIG. 3 and FIG. 4. Therefore, each of the eight resonating circular cavities are formed by the hollowed-out copper anode block core of Item #46, thus forming these eight evacuation chambers which collectively are depicted as Item #54. Finally, FIG. 4 shows the negatively charged and highly electron emissive metallic oxide coated cathode, which is centrally located and shown as the negative cathode of Item #59. This item is coated with an alkaline earth metal oxide compound enabling the negative electrons to be knocked loose and to be dislodged. FIG. 4 also shows up close as an enlarged version the output coupling drawn as Item #52 positioned within the anode resonating cavity on its travel to the wave guide of Item #53.

It is noteworthy to point out that that the high energy voltage from the step-up transformer of Item #44 is the force which dislodges the electrons off the highly electron emissive metallic oxide coated chamber of the negatively charged chamber of the cathode. In doing so it creates an electrical circular magnetic field shown as Item #62 which travels in a circuitous circular path around the cavity between the longitudinally disposed cathode and the anode core. That zig zag wiggley circular path is shown as Item #63. It must be emphasized that this negative cathode is longitudinally oriented shown within the drawing as perpendicular to the plane of the paper which so to speak pierces the plane of the paper and is oriented both vertically upward (toward the reader) and downward (away from the reader) like a pipe within a cavity sleeve from which the circuitous magnetic field is being generated. It is also highly instructive at this point to give the reader a terse summary of the microwave oven's magnetron or Item #78 which consists of a vacuum-like tube; which we know as Item #55 (the resonating cavity) and a strong magnetic attraction such as Item #62. This magnetron produces microwaves which travel through the waveguide of Item #53 and bounce off of the oven's metal interior heating compartment; where in a food kitchen microwave these generated microwaves do not inherently possess any heat per se. Instead, these microwaves pierce the foodstuff and interact physically with only the $H_2O$ water molecule located within the recesses of that food. WHY!!!!! Simply because water is a polar molecule.

The reader at this point must be educated between the kitchen food microwave appliance and this inventive process microwave as a residential heating oven. In scientific parlance, $H_2O$ (water) chemically aligns itself with other water molecules into two separate and distinct polarized moieties. The reader must now picture this physical spatial alignment as a letter "Y" where the top-most moiety contains the two positively charged hydrogen atoms; while the bottom-most moiety contains the negative oxygen atom. Hence, the water molecule stays completely intact but this physical phenomenon of polarity within the water content in the food material causes these microwaves to cause the water molecules to vibrate 245 billion times a second. These numerous vibrations per second produces heat within the foodstuff similar to rubbing your hands together; therefore, that food substance thus cooks simply because the water content within the foodstuff becomes hot or heated. However, for the purposes of this inventive process, we are not using water; but instead a polarized oil such as castor oil. The essence of this polarization comes about as follows. Most fatty oils are produced by the union of one molecule of glycerol plus three fatty acids. Contained within each fatty acid are three carboxyl groups, possessing the chemical moiety known as —COOH. Hence, similar to water this latter carboxyl group aligns itself as a polarized entity where the carbonyl radical C—O becomes positive as in an acid; while the —OH hydroxyl radical becomes negative. Therefore, the net effect is similar to water. The reader is now directed to view FIG. 7 where the chemical formula for this oil is shown as Item #104. Glycerol is shown as Item #101 and the three fatty acids containing the polarized COOH radicals (shown as cross-hatched) and designated as Item #102, where also the fatty acid is being shown as Item #103 and the castor oil fluid heating oil medium as a triglyceride shown as Item #104 (the chemical structural formula) and Item #96 as the fluid oil medium.

Therefore, it is not the water molecule within this inventive process which is made to vibrate by these microwaves producing heat; . . . instead it's the polarized castor oil; as Item #104 or Item #96 which vibrates and produces the heat. Normally, in a conventional food microwave oven the water molecules within the food stuff vibrate billions of times per second from which this agitation causes the water molecules to move faster and faster. The reader is encouraged to entertain the illustration of a person rubbing his two hands together fiercely and thus generating heat from the forces of friction. Therefore, in the conventional food microwave oven, that oven's electromagnetic field oscillates as it passes through the water molecules thus changing its polarity within the field and as a result causes the dipole/water molecules to flip themselves in order to be aligned with the new polarity. Remember those opposite charges previously explained in the "Y" shaped orientation. [i.e. two positive hydrogens and one negative oxygen) Hence, heat is created by this resulting friction of the water molecules; (however only in a food microwave oven) thus reversing direction billions of times per second attributable to this change of polarity. In other words, a conventional microwave oven works by causing the water molecules, which have two opposing poles (i.e. the positive H+ and the negative OH−)

to spin rapidly. Because of the polarity spinning molecules like water which is polar; . . . and special oils which are also polar like castor oil; . . . these chemical moieties will constantly align themselves within this magnetic field which they are subjected to.

By and large, microwave radiation creates a magnetic field that oscillates, shown in FIG. 4 as Item #62 (shown as the wiggley loops) and Item #63 (shown as the dotted circular path); which means that this field is constantly changing its orientation (which is the direction the positive and negative charges face). Those directional shifts make polar molecules like water and certain oils, sch as fatty acids (see Item #103 FIG. 7) start spinning as they try to keep up with the changing charges. On the whole, as the molecules spin, they generate heat. This process is known as dipole rotation or di-electric heating. Dipole means having two different and opposite poles. In sum and substance, also is referred to as radio frequency heating or high frequency heating and is the process in which a radio frequency (i.e. a microwave) alternating electric field or radio microwave transmission with this electromagnetic radiation heats up a dielectric material like water or castor oil.

The reader must appreciate that polar oils contain heteroacids, which differ in electronegativity and also consequently result in a dipole moment. Typically, polar oils are fatty alcohols; . . . witness the polarized carboxyl (—COOH) groups shown as cross-hatched as in Item #102—FIG. 7) as well as the ester of fatty acids shown as Item #103 and triglyceride of Item #104. However, while these oils are still water insoluble and oil loving, these oils have this unique characteristic the same as water due to the nature of their polarity. Having thus explained the necessity of polarity within this polar heated oil it must also be mentioned that in order to generate this heat, microwave ovens require at least 3000-4000 volts in order to generate the required heat necessary. Please be aware that ordinary household standard electric outlets use only 120 volts of power. Hence, it is the high voltage transformer of Item #81 which converts that lower 120 volts into higher heat energy for the purposes of this invention. As explained earlier, the waveguide of Item #53 funnels these microwaves into the heating compartment of Item #60. The cooling fan of Item #79 prevents the microwave oven from overheating. If too many heat waves build up then the appliance may become too hot which automatically turns on the cooling fan. Here within this process, the microwave heats by exciting the polarized carboxyl group (—COOH) within the mineral oil molecule making them vibrate and rub against each other. As the molecules vibrate, they produce heat (just like rubbing one's hands together vigorously).

Furthermore, as these microwaves pass through the castor oil, these molecules also flip back and forth following the sine waves zig-zag pattern. These microwaves have a frequency of 2.45 giga hertz so they thus flip these molecules 2.45 billion times per second. This rapid back and forth movement is what causes the castor oil to heat up; also known as dielectric heating. This mineral oil has a capacity of withstanding an internal temperature of 600 degrees F. Therefore, microwave frequencies because of their length, can range from one billion to about one hundred billion cycles per second. Hence, since a giga hertz is a billion cycles per second, that's one to one hundred giga-hertz. So in general, these microwaves are produced primarily by this rapid oscillating electric or magnetic field. Accordingly, when this microwave frequency of 2.45 giga-hertz is applied to a water molecule in a food substance, or the fatty acid of the castor oil; . . . it starts vibrating rapidly and oscillates at that frequency. However, within the inventive parameters of this utility patent application this inventor intends to vibrate the polar carboxylic acid radical group (COOH) within the three fatty acids of castor oil (see Item #103 FIG. 7). Hence, the magnetron of Item #78 as a microwave generator is a device that simply is designed to oscillate within a magnetic field at about 2.45 gigahertz or 2.45 billion cycles (or times) per second, thus generating heat. This microwave oven compartment of Item #60 thus heats up the castor oil by exposing it to electromagnetic radiation in this precise microwave frequency range. This induces the polarized molecules in the castor oil; in particular and specifically the carboxyl group (the COOH—see Item #102 FIG. 7) to rotate and produce thermal heat energy in a process known as di-electric heating.

This heating process is also known as high radio frequency heating. Perhaps at this juncture a rather brief summary is needed once again to elucidate this heating process. By and large this heating process begins with the negative central circular cathode of Item #59; which for all intents and purposes is the highly electron emissive component which is centrally located and then subsequently heated by the high voltage transformer of Item #81. Please note once again that this cathode is in reality a solid longitudinal metal rod at the very center of the magnetron and is thus coated with a well-known alkaline-earth metal oxide compound; such as calcium oxide, or magnesium oxide, from which the high voltage from the transformer of Item #81 then knocks off electrons from this metal oxide coating. In other words when the magnetron is energized by this high voltage electricity from FIG. 3, electrons boil off from this cathode of Item #59 and zip across to the anode of Item #55, which is one of eight resonating cavities being utilized as evacuation chambers within the core of the anode block of Item #54. It thus behaves just like an electron beam. However, prior to its entrance into the eight resonating cavities; . . . a powerful magnet located along the entire longitudinal axis of the cathode thus creates this circular wiggley magnetic field of Item #62; . . . which then follows a curved circular path of Item #63 (shown as a dotted circle) within this magnetic field whereby this field is located right between the anode and cathode.

Accordingly, this magnetic field courses parallel to and alongside the full length of the cathode (much like a solid rod within a metal tube) Therefore, when these electrons try to transmigrate or zip from the cathode of Item #59 to one of the eight resonating cavities of the anode of Item #55 they begin first by travelling through this electric field which is produced by the powerful magnet underneath. Note that for the most part this magnetic field runs parallel to and lies between the cathode and anode) Hence, just like any electrically charged particles which move in an magnetic field, they are swept into this magnetic force field and thus follow a curved path instead of proceeding in a straight line; they then begin a wiggly cork screw path down the entire axis between the anode and the cathode. Next, as these electrons zip past the eight resonating cavities of Item #55; these latter cavities then resonate and emit microwave radiation. The reader is encouraged to think of this process where the electrons pass their energy to the resonating cavities; thus making them resonate just like a person blowing on the mouthpiece aperture of a flute's open end. However, instead of producing melodic musical sounds the cavities produce microwaves. Recognize that the airstream blowing over the flute's mouthpiece creates a Bernoulli or siphon vacuum effect which then further excites the air contained in this cylindrical resonant cavity within the flute. Therefore, in an analogous fashion this microwave radiation; which the resonating cavities of Item #55 produce, are then collected up and channeled by a kind of funnel called the wave guide of Item #53 and are subsequently directed into the heating compartment of Item #60.

The reader must not lose sight that said magnetic force field of Item #62 and Item #63 which flows across the narrow opening of the resonating cavity of Item #55; just like the flute and the Bernoulli effect then resonates and generates microwaves which have a wave length and vibration potential of 2.45 gigahertz which are then scooped up by Item #52 and Item #51 which are one of two output coupling loops for transmitting these magnetic wave oscillations. It must also be appreciated that this in effect is only potential energy. The effective real heat energy only become realized when the polarized carboxyl radicals (i.e. COOH see Item #102 FIG. 7) vibrate within the three ionized fatty acids at 2.45 billions of cycles per second and thus produce heat within the castor oil.

The reader is now urged to focus upon all of the foregoing text regarding the heat now being created within the castor oil fluid as the heating medium now imbued with potential heat energy. Before we embark upon this rhetoric the reader must first re-visit the FIRST EMBODIMENT where the potential temperature thus being created by the FREE heat production from the organic decomposition composting procedure was touted to be between 105 degrees F. to 165 degrees F. Let us compromise and instead theorize that the mean temperature gradient within the heating compartment of Item #60; before the electric 120 volt current of Item #43 is switched on; is instead between 105 degrees F. and 165 degrees F.; and therefore resides midway at the mean gradient temperature of 130 degrees F. We must still recall that this is still FREE heat from the composting procedure of the FIRST EMBODIMENT. It thus becomes axiomatic that upon a fair perusal of the chart on Page 13 showing the 50 states of the United States relative to their lowest known average temperature during the freezing cold winter months; . . . that this theoretical 130 degree F. mean gradient temperature might just suffice for heating comfort in some of those 50 states.

Additionally, other construction variables and temperature considerations come into play as a direct result of the normal vicissitudes surrounding the different dwelling factors that the millions of homeowners will encounter. In sum and substance, most homes are not the same temperature in every room, since the number of windows; the different insulation characteristics; the different room sizes; the different ceiling heights can all vary significantly from dwelling to dwelling. By and large then, we can all agree that the SECOND EMBODIMENT starts off with and begins with several vital questions. FIRST—and foremost is what is the mean temperature gradient within the heating compartment of Item #60 before the electric current of Item #43 is turned on. The SECOND question is what precise event should trigger the turn on current switch of Item #43; which begins the heating process within the process of Step 2. The THIRD question is; . . . will this heating compartment of Item #60 and its controlling on/off device of Item #43 switch on and off intermittently, or perhaps remain constant with seamless heat energy being delivered. That first question is unquestionably an independent variable which does not depend on any other variable for its outcome.

In short, we can all agree that the specific temperature coming off the compost bin and into the heating compartment of Item #60 before the electric current switch of Item #43 is turned on must undoubtedly be ascertained. However, the second question is a dependent variable which then becomes a function of the quintessential heat or temperature modulating device known as the ubiquitous room thermostat. The science behind this thermostat within this SECOND EMBODIMENT is fairly simple. As things heat up within the dwelling the bi-metal conductor probe expands. If things cool down, it will instead contract. This simple mechanical function allows the thermostat to switch on and off the electric current which will energize Item #43 which begins to produce microwaves to generate heat within the heating compartment of Item #60. At its core then, the thermostat is simply the brains or controlling device used to regulate the temperature of the homeowner's dwelling. You thus, can set a preferred temperature; . . . let's say 72 degrees F.; . . . and the thermostat works to keep your dwelling interior at this desired level.

If, however, the home starts to drop in temperature because the outside temperature drops drastically; this thermostat switches on the heating compartment of Item #60. to warm up once again the dwelling's interior rooms. By and large, after this interior temperature within the dwelling's rooms has reached the set point of 72 degrees F.; . . . the thermostat next works to switch off the heating compartment of Item #60 to prevent the homeowner from getting overheated. We highly recommend using the smart Google thermostat known as NEST; which is of the digital type, whereupon this device learns and adapts to the homeowner's individual desires and routine within his dwelling. Therefore, to adequately begin to address the specific complex ramifications within this SECOND EMBODIMENT it thus behooves the homeowner to learn the actual temperature residing within the castor oil heating medium as it immediately exits the back of the heating compartment of Item #60. To accomplish this, we propose to enlist the remote monitoring technology of a company named MONNIT located in Salt Lake City, UT 84115—phone 801-561-5555.

They will provide a fixed thermocouple which is a temperature measuring device, consisting of two wires of different metals joined at each end. A multimeter is then added to this circuit where the temperature difference causes the development of an electromotive force which is proportional to the difference between the temperatures of these two junctions. This multimeter can be thus calibrated to extrapolate the exact reading to measure the temperature within the heating compartment directly. In reality this task is accomplished as follows. The thermocouples monitoring probe is inserted into a small hole drilled into the back end of the PVC fitting of Item #87. Thus, this probe is herein identified as Item #88, which in essence is a wireless sensor which detects the temperature in the castor oil at Item #87 and transmits this information to MONNIT's other device, which is a wireless gateway which in turn transmits that important information to online monitoring software. This foregoing technology enables the thermostat which is a high tech learning thermostat manufactured by GOOGLE's NEST (contact 1-855-925-7081) to modulate the specific temperatures desired in all six locations of the dwelling. To fully appreciate the efficacy behind this necessary NEST thermostat learning curve of the SECOND EMBODIMENT, the reader must now focus on this process's second step and compare it to both conventional interior heating methods utilizing only fossil fuels for their operation.

One is the typical Oil Fired baseboard hydronic oil burner. While the other is the GasFired forced hot air-furnace system distributed through ductwork and registers. Both are central systems responsible for providing 100% of the dwelling interior's heating requirements, wherein the shortcomings of both of these systems is attributable to the varying vicissitudes and different characteristics of the many dwelling's areas which we previously mentioned on page 21 last paragraph. For example, one room in particular may cause the central heating apparatus to fire often due to their individual inherent insufficiencies. This is where our SECOND EMBODIMENT has marked superiority over both of these central fossil fuel dependent systems.

Instead, we now desire to convey to the reader where earlier we made note that this inventive process relies upon three composting bins (FIGS. 1 and 2) and three microwave heating ovens (Item #60) which mathematically means that each of the three heating compartment ovens of Item #60 is only responsible for 33.3% (100 divided by 3) of the dwelling's heating requirements. Therefore, the homeowner needs to program each microwave oven differently and separately. We must now re-visit the theoretical proposition where we assume that the mean gradient temperature within the heating compartment of Item #60 resides at 130 degrees F. before the current of Item #43 is turned on via the NEST thermostat. What the homeowner needs to know now is what is that precise mean temperature gradient within the heating compartment of Item #60 at all three microwave ovens. Thus, the homeowner begins this learning curve by setting his six Google NEST smart learning thermostats to an arbitrary 72 degrees F. temperature.

Hence, the hallmark of energy efficiency is first and foremost obviating the requirement for the homeowner having to rely on fossil fuels to heat his dwelling. However, another necessary ingredient is to save electric energy by not having the heating microwave oven turn on and off intermittingly. Instead, this inventor intends to furnish within the component compartment of the microwave heating oven a novel feature which is not customarily found within food microwave ovens. This avant-garde device is the inverter of Item #29. The aim of the inverter technology is to provide a seamless controlled and efficient constant power supply operating continuously at the same uniform power in order to avoid overheating. Therefore, in a conventional kitchen microwave oven, power is supplied solely through the transformer of Item #81 which turns the power on and off periodically. For example, if you set this conventional microwave to deliver 50% power, it will actually go through periodic on and off cycles of producing 100% power, followed by a period of no power to ultimately achieve this 50% of power desired.

Instead, with a microwave oven outfitted with an inverter within this process, as we have here with Item #29, the power is supplied through an inverter circuit to supply a steady and constant continuous amount of power without cutting on and off. Therefore, if 50% power is desired, this microwave will deliver 50% power constantly throughout. Accordingly, what is obtained with an inverter microwave is a seamless stream of power or heat. In sum and substance, this additional feature of an inverter technology for this inventive process enables the homeowner to sustain a much lower degree of temperature for a rather lengthy duration of time without having the microwave switch on and off repeatedly; thus becoming more energy efficient. Let us now discuss just how this continuous power delivery affects our inventive process. On page 14 at the very beginning of the text regarding the SECOND EMBODIMENT we herein indicated that a typical dwelling measured 50 feet long by 26 feet wide. We also mentioned that two compost bins would be placed at both the left front side of the dwelling, as well as the right front side and thereafter traverse into the dwelling into the attic. The third or last compost bin would be placed at the very center; however, in the back of the dwelling; and also all three supply hoses of Item #15 end up in the attic.

Since all three supply and return vinyl flexible hoses of Item #15 and Item #16 from those three compost bins each then enter into the attic; they each must service a dwelling distance of 50 feet each in furnishing their heat into the interior dwelling space which means three times 50 ft. equals 150 ft per floor. The precise logistics of this exact distribution within this inventive process will be explained shortly. However, what is important is what is the exact temperature of the heated oil medium when it leaves Item #86 and enters Item #87 which is the transition iron ferrous pipe connection shown as Item #92 FIG. 6. That temperature was theorized to be now 180 degrees Fahrenheit. Therefore, the reader must fully understand that the end terminal fitting of Item #86 from the microwave oven directly engages with the ferrous pipe thread connection of Item #92 of the Pyroceram assembly module of the electromagnetic induction coil and ferrous pipe supply and return components shown within Item #100. The reader must now recognize that this entire arrangement of the placement of all three microwave ovens in the attic and the extreme close proximity of these three Pyroceram assembly modules of Item #100 is vital to an understanding of just how energy efficient the second and third embodiments now become.

Let's begin by first discussing what is normal and customary for the conventional fossil fuel oil fired burner, which utilizes only one solitary ¾" hydronic copper pipe/water filled aluminum fin tube baseboard radiation assembly to heat up a typical two story residence measuring 48 feet long by 26 feet wide; . . . which in essence is the total perimeter distance of travel of 148 linear feet; i.e. 26+26+48+48=148 ft. This boiler typically becomes an expensive proposition with installation. It is usually located in just one area of the house, typically in the basement. Thus, it begins its long perimeter run of 48 feet in one direction with only one singular supply pipe; whereupon at the terminal end of this 48 foot run it makes a left turn and next traverses along the short side of the 26 foot run. Thereafter, it courses backward along the opposite long side of the other 48 feet run; then next makes another left turn to complete the opposing short side run of the last 26 feet for a total combined perimeter distance of 148 linear feet. It also starts out at 180 degrees Fahrenheit from this boiler; . . . where by the time it returns back to that boiler, after surrendering most of its heat energy to wash the exterior outer walls, it thus completes this 148 foot perimeter run; . . . where the return temperature may now be 160 degrees F. Upon return back to the boiler, this cycle renews pursuant to the dictates of the dwelling's thermostat. It must also be emphasized to the reader that this aforementioned solitary one pipe aluminum fin tube design is not pursuant to that which is depicted within the Third Embodiment of this instant invention; i.e. there are no pyramidal projections on the aluminum fin tubes, therefore the heated air goes straight up within this conventional design without being impeded by the novel pyramidal projections; . . . and as a result thereof will not potentially retain its inherent temperature for a much longer period of time as this Third Embodiment teaches.

Third Embodiment

At this juncture the reader has learned that the typical conventional fossil fuel hydronic baseboard design essentially involves a circuitous loop arrangement involving a lone singular pipe design coursing a total perimeter run of 148 linear feet coming off one solitary central heating plant which is the oil fired boiler. Now let's contrast that design arrangement with this inventive process and explain what is uniquely different about this instant novel inventive design. As mentioned previously within the FIRST EMBODIMENT there are instead three separate compost bins whose inherent vinyl tubing culminates within the three separate individual microwave ovens located within the attic. These three separate microwave ovens of the SECOND EMBODIMENT are in very close proximity and immediately connected to the electromagnetic Pyroceramic induction coil assembly ferrous iron pipe supply/return module of Item #100—FIG. 6. It is thus within this novel latter feature that the 180° F. temperature generated within the microwave oven is immediately raised to 230° F. within this Item #100. For clarification the reader is urged to consult FIG. 6; whereby at the lower right-hand side of that drawing the reader learns that the interface connection from the microwave oven directly into the Pyroceramic induction coil assembly module occurs at Item #92 into two distinct supply branches which is shown as the projecting exterior section of iron ferrous pipe residing outside of the pyroceramic housing envelope of Item #100 used to connect to Item #87—FIG. 5, from that microwave oven. First and foremost, it thus behooves the reader to learn just what induction coil heating is, as an applied science. Induction coil heating is the process of heating electrically conductive materials like the ferrous iron pipe of Item #112 by electromagnetic induction; through the process of heat transfer passing through an induction coil which is Item #98—FIG. 6; shown as the metallic electromagnetic induction heating coil which creates an electromagnetic field shown as Item #93 around these two induction coils to heat both separate supply sections of both ferrous iron pipes within FIG. 6. Please note that one pipe (the lower elevation) services the second floor as riser Item #114—FIG. 10 while the other pipe (the higher elevation) services the first floor as riser Item #115—FIG. 10 *a*.

By and large, the reader must appreciate that the ultimate boundary limit and area of total coverage of this 230° F. heat energy being produced by this aforementioned electromagnetic heat energy conductive transfer is shown graphically as Item #93, the extent of which is shown via Item #94 within the ceramic housing of Item #100. In essence both entire ferrous iron pipes are infused with this higher temperature and via conduction they both transfer this heat energy to the now much hotter oil medium within the pipe lumen's interior cavity shown as Item #96—FIG. 6. It must be emphasized that this inherent temperature is constantly being modulated by the radio transmitter frequency of Item #110 generating a signal via its antenna to broadcast and record the oil medium temperature via the thermocouple inserted into the two ferrous iron pipes. The ferrous iron pipe thread of Item #97 is used to now connect with a special fitting to transition to rigid "K" copper tubing of Item #99. It is noteworthy to point out that from the attic this copper pipe now descends downward through the exterior stud wall space and begins its lateral travel accompanied by the attached aluminum fin tube panels shown in FIG. 6 as Item #105 (thirty-two dark pyramids) which projections face the reader and immediately located below the latter; as part of that same continuous aluminum panel the lighter pyramids shown as Item #106 (thirty-two light pyramids) which projections face in the opposite direction and orientation as those above. For clarification of this arrangement the reader is urged to visit FIG. 9.

For the reader to gain a greater understanding of just how this unique fin tube design creates enormous energy efficiency, the reader is now encouraged to visit FIG. 10—which graphically depicts the three separate seminal origins of Item #99 which now provides the beginning basis for further development of this aluminum fin tube arrangement at the second floor level immediately below the attic. Please note that soon after leaving the Pyroceramic electromagnetic induction heating coil assembly of Item #100 that rigid copper pipe section of Item #99 shown in FIG. 6 now becomes a vertical descending riser elbowing downward through the exterior outer stud wall space to the dwelling's second floor below and graphically shown as Item #114—FIG. 10. There are in fact three distinct locations shown within FIG. 10 for these three latter descending risers; two at the front corners (i.e. extreme left side and extreme right side) of the second floor plan and the third one centrally located at the very rear of this second floor plan. The reader is now being asked to view FIG. 6 and to take careful note that the rigid "K" type copper tubing shown as Item #99 leaves the Pyroceramic induction heating coil module of Item #100 for the second floor at a lower elevation plane, whereby it is now being characterized as the "supply" tubing. Please note that this supply tubing is also accompanied by the multitudinous array of aluminum pyramidal projection fins shown as Item #106 (the lower inferior lighter version) and additionally also contains Item #105 (the upper superior darker version). However, the reader must be made aware that when the rigid copper pipe of Item #99 pierces the latter fin tube assembly of Item #105 immediately above, it now becomes instead "return" tubing.

The reader is now urged to consult both FIG. 6 and FIG. 10 simultaneously together. Let's begin our analysis of this unique fin tube arrangement as the reader begins to view Item #114 located at the lower left-hand corner of FIG. 10; which is in fact the second floor layout of this dwelling. Follow the supply tubing directional arrows (at the lower elevation of FIG. 6) as this Item #99 rigid "K" copper tubing with its attached Item #106 pyramidal fin tube panels courses twenty-six feet along the baseboard of the left hand short side of this second floor dwelling. FIG. 6 and FIG. 8 show two 90° copper elbows as Item #107 which both change the direction of oil flow from the "supply" lower elevation shown as Item #108 to the "return" higher elevation shown as Item #109 (dashed lines within FIG. 10). Recognize that this "return" hot oil medium also now courses perpendicularly to the right along the front baseboard aspect of the second floor dwelling. That aforementioned longitudinal run courses only twenty-five feet to the right, after which once again two elbows of Item #107 change it's directional flow from the previous higher elevation through all of the upper pyramidal fin tube panels of Item #105; whereupon they now transition to the lower elevation "supply" tubing and pierce the aluminum panels of Item #106 and thus commence backward toward the left and the corner terminal location of Item #16. Thus far within this tubing's spatial orientation just discussed, it can be fairly concluded that both the "supply" and "return" tubing have traveled a total distance of fifty feet each. However, the energy efficient effective heat coverage via convection currents is in reality one hundred feet attributable to the double tier alternating stacked configuration designed as Item #105 and Item #106.

Before we embark upon the merits of this energy efficient configuration, let us conclude what next occurs with this tubing design when this "supply" tubing finally reaches its end point terminus of Item #16 at the left-hand corner after travelling fifty feet laterally along the left side and front left side of the second-floor dwelling. That terminal supply tubing having concluded its fifty foot travel at the second floor level now courses downward as a descending "return" riser back to transition into the vinyl tubing into the compost bin to repeat this tripartite cycle anew (i.e. the compost bin (FIRST EMBODIMENT); the microwave oven (SECOND EMBODIMENT) and the pyroceramic electromagnetic ferrous pipe induction coil assembly (THIRD EMBODIMENT). The reader at this point is urged now to consider upon visiting FIG. 10 that the explanation of what occurs with the descending riser of Item #114 on the second floor at the left-hand corner, is exactly identical as the same thing for the right-hand corner as well; additionally including the rear riser located in the exact middle of the back of the dwelling second floor level. Therefore, in sum and substance, each of these three risers of Item #114 on the second floor completes a travel distance of only fifty feet and not the 148 feet of the typical conventional design. In sum and substance; the three separate runs of 50 feet each equals the same 148 perimeter linear feet mentioned earlier from the customary fossil-fuel conventional design but instead; unlike the conventional design, now assumes that each of these three risers are instead responsible for one-third or thirty-three percent of the energy contribution to heat the second floor. What now occurs at the first-floor level is the following. For the appropriate explanation the reader is urged to first consult FIG. 6 once again. At the right-hand side of that drawing it is revealed that Item #92 which comes from the microwave oven "tees" off to form a second supply branch which enters the protruding portion of the black ferrous iron pipe on the left-hand aspect of the Pyroceramic electromagnetic induction coil module of Item #100. That entry is shown at the upper aspect of that module on the return side. Suffice it to say this now 180° F. temperature coming from the microwave oven instead enters the Pyroceramic module of Item #100 whereby the oil medium now gets raised in temperature to 230° F. Please note that the second radio frequency transistor modulating temperature sensor of Item #110 is located just outside that module to regulate this oil temperature. Thereafter this ferrous iron pipe now immediately transitions into "K" type rigid copper tubing and now descends downward through the exterior outer wall stud space past the second floor and instead enters the first floor (see FIG. 10 *a*) to repeat a distribution pattern exactly identical to the second floor layout of FIG. 10. This latter floor plan of FIG. 10 *a* is the graphic representation of the floor immediately below the second floor shown in FIG. 10; which is in fact the first floor piping distribution layout. FIG. 10 *a* shows at the left hand corner Item #115 which is the descending riser coming down through the exterior outer stud wall space from the attic and follows an identical distribution circulation pattern identical with the aforementioned second floor description. Please note graphically that Item #115 is shown as a clear open circle and not as a dark circle as in Item #114.

Perhaps the best explanation for just how this dwelling space is heated is to provide the reader with a primer on the thermodynamic science of just how "convection air currents" operate within the interior dwelling of one's home. Convection air currents form because heated air expands, thus becoming less dense, where subsequently the molecules of that warmer air spread out. Because the oil medium within the lumen of the copper pipe of Item #99 was heated to 230° F. by the ferrous iron pipe; this then less-dense heated warmer air rises up and away from the heat source of the rigid copper pipe of Item #99; which is intimately connected to Item #105 and Item #106 of FIG. 6; the aluminum fins via Item #111. Therefore, as it rises up, it simultaneously pulls the cooler air above it down to replace it. This former cooler air in turn now also becomes heated as well, then subsequently this immediately newly warmed air also rises up and begins to pull down more cool air. This circuitous cycle repeats over and over again. Picture if you will a revolving pin wheel. Hence, this circuitous convolutional gyration cycle establishes a circular current of constantly moving gas or air; . . . that only stops when heat within the room is evenly distributed throughout the interior dwelling space of that particular room; and only when the thermostat set at 72° degrees F. has been satisfied. For example, FIG. 6 and FIG. 8 and FIG. 9; . . . in reality thus all become hot double tiered baseboard radiating panels; and thus will heat the air immediately surrounding it. It is now necessary for the reader to re-visit the primer on "convection air currents"; previously explained above.

Once again, this heated air rises toward the ceiling, thus pulling cooler air above it down from the ceiling and into the radiator fins of Item #105 and Item #106. to be heated. This process repeats itself until the air in the room is evenly heated according to the temperature setting programmed on the Google Nest learning thermostat by the homeowner. Now however, the reader may ask and question why the necessity for the dual redundancy within EMBODIMENTS TWO (microwave oven) and THREE (induction coil assembly). Hence, our discussion must now begin by re-visiting our theoretical working temperature from the FIRST EMBODIMENT (composting bin) as it enters the microwave heating compartment oven of Item #60 shown within FIG. 5. That Item #15 is in fact the supply flexible vinyl hose coming from the exterior composting bin located outside. Earlier, we hypothetically assumed a temperature range within the compost bins of between 105° F. to 165° F. therein; and of course, logic would then dictate instead an obtained mean gradient temperature of 130° F. It thus becomes a foregone conclusion that it is far easier to heat 130° F. warm castor oil to 180° F. from 130° F.; where the additional heat energy required from the microwave heating compartment of Item #60 needs only an added 50 degrees of additional heat energy; . . . (especially with the inverter of Item #29).

Next, we observe that this 180° F. exits Item #60 at its rear terminus shown as Item 86, and now enters Item #88, which is the pipe fitting which connects the Pyroceramic induction coil assembly module of Item #100 FIG. 6 and subsequently FIG. 8 with its array of aluminum fins. Please note that the homeowner initially set his Google Nest thermostat at 72° F. Therefore, as this thermodynamic process begins its travel in each direction of the three 50 foot branches through the dwellings interior rooms; . . . the 230° heat is simultaneously being surrendered to the cold outside 20° F. ambient air as disclosed on page 27 within our primer on "convection air currents."

This feat becomes eminently doable because of the avant-garde novel patentable features herein being shown which will inure to facilitate the transfer of thermodynamic heated air molecules of warm air wafting up as newly rising heated air currents moving upward and thereby forcing and replacing at the ceiling level the cold convection air currents downward; which in turn themselves now become heated as a result. However, it must be noted that a comparison must be made between the old customary conventional hydronic baseboard radiation design, in contrast to what is being proposed within this patent application. By and large, the old conventional hydronic baseboard design has aluminum fins which measure 2¼"×2¼" square with a ¾" hole punched out directly in the middle to pass through that singular heated copper pipe. These fins were thus assembled around that lone singular heated copper pipe and stacked end to end in repetitive succession, each about 3/16" apart; thereby creating uniform spaces between each succeeding fin. Once again, by the reader now re-visiting that primer on ""convection air currents" described on page 27; it was learned that from a longitudinal slot located at the very bottom aspect of the baseboard, which is positioned slightly above the floor plane; whereby that slot measures 1¼" high; . . . then those very dense cold air currents in typical pin wheel rotation, thus get scooped underneath this latter slot and begin to rise because they are simultaneously being heated. This process is accomplished as follows.

In this old conventional system the ¾" pipe which comes off the customary oil burner at 180° F. heats the aluminum fins via conduction in a very similar fashion as this patent application does; but only to a certain extent. However, we recently learned that this same cold air which is quite dense, then starts to rise upward as it becomes heated, and as a result thus becoming less dense, while it passes upward past the 3/16" gap space located from aluminum fin to the adjoining next aluminum fin. Accordingly, since there are no structural pyramidal impediments as designed within this instant novel inventive process; the heated air current instead rises faster and unimpeded in its travel upward; . . . thereby lacking sufficient time to heat up significantly via the process of conduction. In other words, it is not being afforded sufficient enough time to extract as much radiant heat from the very hot and much smaller aluminum fins. Therein lies its inherent design flaw and of course shortcoming of the old conventional design.

Additionally, since those smaller aluminum fins measures only 2¼"×2¼" its effective hot surface area is less than five square inches due to the ¾" round copper pipe piercing its midsection. Please note that all of these aluminum fins are attached to the ¾" copper pipe via Item #111 which aids in the conduction and transfer of heat energy. In reality then, there is only about four inches of effective hot conductive surface area for conduction to occur. Now let us focus and compare this design's merits. For the most part, we now urge the reader to view FIG. 8 wherein we can theorize that our newly designed aluminum fin is a two-tier duplex unique arrangement which instead measures 3" wide by 6" long; or in fact 18 square inches. This measurement is more than three times the surface area of the old conventional 5 square inch design Therefore, this instant patentable design and unique aluminum fin configuration consists of Item #105; located at the top and Item #106 located at the bottom. It must therefore be noted that each of these duplex fins now has instead, not just one, but two central pipe assemblies coursing through its mid-section from this two-tier stacked design.

Please note that the difference between both pipe assemblies is as follows. Item #108—FIG. 8 depicts the castor oil medium within the supply tubing coming from the Pyroceramic electromagnetic induction coil assembly module of Item #100 and flowing to the left. At its 25 foot terminus within the dwelling's interior rooms it terminates in an elbow of Item #107 (also see FIG. 9) fitting and then continues coursing upward into another Item #107 elbow fitting; and then abruptly begins its travel backwards as a return flow down to the compost bin as Item #16. Please note that this flow back to the compost bin is shown as Item #109. It now behooves the reader that in order to gain a more thorough and better understanding of the quintessential unique design features being incorporated within the aluminum fins of Item #105 and Item #106; it will be necessary to view FIG. 8 in conjunction with FIG. 9. With regard to FIG. 8 the extreme left-hand drawing shows Item #105 as darker in tone than the bottom aspect of Item #106; which is lighter in tone. By and large, this unique function and design comes about as follows.

During the stamping process of producing these fins, a male die thus produces and punches out 32 pyramidal projections which stamps out these rather small four sided sloping pyramids shown as Item #105 and therein shown with a darker tone; . . . which are all projecting out from the plane of the paper drawing towards an orthogonal view to the right with their apex or apices facing the reader. In the opposite analogous situation, the reader is now encouraged to view the second adjoining aluminum fin in proximate succession as the top aspect second from the left (but to the right of Item #105) within FIG. 8. Here in this drawing, that second aluminum fin from the extreme left-hand side top is shown as Item #106. Here within this illustration the reverse situation controls. Instead, these subsequent similarly stamped 32 pyramidal projections which are shown in a lighter tone have the male die punch or stamp these four sided sloping pyramids away from the plane of the paper drawing; where instead their apices will kiss or touch the corresponding and aligning apices from the aluminum fin previously discussed; . . . which is the top-most and to the left; i.e. Item #105, which is located at the extreme left side of the drawing FIG. 8.

Now is the time for the reader to engage the drawing of FIG. 9 and view the extreme left hand drawing of aluminum fins where Item #105 has its apices touching and kissing so to speak the top-most version of Item #106 each panel mating and touching at their corresponding apical ends. Perhaps the most important insight from this entire illustration is that the 32 four sided sloping pyramids or 64 twin pyramids (i.e. top and bottom halves) alternate such that in one vertical row the 64 apices meet at the top; . . . whereas in the next immediate adjoining row the 64 apices meet instead at the bottom. If the reader now understands this unique design concept; we have to now convey just how this unusual creative approach further enhances the delivery of heat energy into the dwelling interior rooms. The best explanation is the following. For this discussion we have to educate the reader once again to revisit the primer on "convection air currents" described on page 27. This primer on "convection air currents" proves one central concept; which is the fact that the heated air becomes less dense and rises upward; thus forcing or pulling down the more dense colder air.

The reader must become educated to the fact that these convection air currents come about attributable to the science of thermomolecular kinetic energy of these moving gas particles. Which basically states that it's the motion of these molecular gas particles which imparts them with this kinetic energy of the convection gas currents due to their inherent motion that predominantly and customarily move in a straight line motion until they collide with another gas particle or perhaps with the walls of this invention's sloping pyramids; i.e. Item #105 and Item #106 projecting into their path of travel, and thus impeding their upward movement. Hence, the reader is now encouraged to view FIG. 11 which shows the aluminum fin tube assembly with a bottom view looking upward at the convection current's path of travel up from the floor plane and heading skyward toward the ceiling of the dwelling's room. Item #105 is known as the darker pyramidal image while Item #106 is known as the lighter pyramidal image; but in this drawing they are graphically shown as equal. Also see FIGS. 8 and 9. Accordingly, from a fair interpretation of what happens as these moving kinetic gas molecules start their upward ascent, they automatically; because of this invention's unique design, become impeded in their upward travel by the sloping pyramids of Item #105 and Item #106. Therefore, the science of this kinetic energy force dictates that since Item #105 and Item #106 block or thwart the gas particle's upward travel; these gas particles automatically are forced to shift their forward upward direction to either the left or right side of those sloping pyramids and thus create an increased greater amount of gas pressure by crowding and funneling into Item #123; whereby this latter route becomes their only avenue of escape upward toward the ceiling. In essence that latter item translates into the only upward corridor heading toward the ceiling; . . . which escape corridor emanates from, and is formed by the pyramid's inherent design voids.

Hence, this increased pressure from a greater amount of kinetic energy force exerted thereof and also the greater thermomolecular gas particle collisions; these combined factors thereby automatically increase the temperature of these convection currents; . . . which translates into free renewable energy; that is energy not formed from either fossil fuels nor even from the electric induction coil assembly.

How can the reader verify that this increased free temperature actually occurs. It thus becomes a scientific fact that this heated air now has kinetic energy which is the energy possessed by this gas now set in motion. Therefore, molecules moving in space within the dwelling's room; . . . all possess these moving gas molecules which have this kinetic energy set in motion. For the most part then this is the scientific principle behind Gay-Lussac's Law.

Accordingly, we now must also learn about Boyle's Law of Gases which involve the three interrelated prime factors of pressure; temperature; and volume. Simply stated that law provides that in a closed container (thus, for the purposes of our discussion we now must consider the homeowner's dwelling space or room as a closed container) . . . when you keep the air volume constant and unchanged; . . . then as the temperature of that gas increases, so does the pressure. It thus also becomes an axiom or a scientific fact conversely; that if you likewise automatically, via this invention's graphic pyramid arrangement from FIG. 11 increase the pressure of this gas (air) pursuant to this inventive design, then you automatically thereby increase its temperature as well.

In other words, pressure and temperature are both directly proportional to each other. Thus as these air currents circulate upward through the gaps within the vertical rows created by the myriad of fins; . . . they collide against the walls of the fins as in Item 122—FIG. 11, with a now greater surface area than the old conventional fins. They also collide with the four sided sloping pyramidal faces as well. Please note that for every row there are a total of 64 sloping pyramids for this rising air current to collide with. Hence, these numerous molecules, as they ascend upward are more likely to collide with either of a fin's walls or perhaps one of the four sloping faces of any of these 64 pyramids. Suffice it to say the likelihood of these probable collisions is far greater than the air molecules escape upward beyond the limits of the fin tube assembly of FIG. 8 and FIG. 9. Hence, these greater amount of collisions, automatically increase their inherent temperature; simply because this unique design has now created greater pressure.

We can theorize a myriad number of collisions as they become enhanced and greater in probability because there is soon another newly less dense formed air current below which now gets heated as well and therefore that newly guaranteed encounter therefore increases the likelihood of far greater number of collisions. This scenario creates even greater pressure within each and every row of the 25 foot-long fin tube assembly as previously described. This increase in pressure according to Boyle's Law is explained by the kinetic theory as arising (according to Gay Lussac's Law) from the force exerted by the air molecules or atoms impacting off of the walls of the fins and the four sloping sides of all 64 pyramids of Item #122. Accordingly, pursuant to Boyle's Law, pressure and temperature are directly proportional to each other. Therefore, when the pressure in this particular design system of gas particles is increased due to these myriad greater number of collisions within their escape route of Item 123; then these air molecules within the gas move faster, exerting even greater pressure and therefore more collisions against the walls and sloping faces of the pyramids; as well as that escape route of Item #123—FIG. 11.

In theory then, since we are not changing the volume of the gas or air within the homeowner's room; then this volume is being held constant. Therefore, this increased pressure of that gas or air is directly proportional to the increased temperature. In other words, we know intuitively that these myriad collisions cause increased pressure, where the collateral result according to Boyle's Law is a proportional increase in temperature. Hence, please recognize once again that this is FREE heat, without having the Google Nest smart thermostat to turn on the current to energize the induction heating coil of Item #98. The reader must remember that the temperature in the castor oil medium of Item #92 from the PVC tubing is 180° F. We also desire a temperature from that induction coil of Item #98 of 230° degrees F. to transfer that heat from the copper pipe of Item #99 to the aluminum fins of Item #105 and Item #106. In theory therefore, this may not be as energy intensive due to the avant-garde 64 pyramidal design of Item #105 and Item #106.

Now in order to extract a greater understanding of this automatic FREE energy as the scientific principle underlying the interrelationship between both pressure and temperature as being directly proportional to each other, the reader must now turn to FIG. 11. First and foremost, that graphic representation therein is a view looking skyward toward the ceiling of the room to be heated at the very underside of the typical fin tube assembly of this inventive process. For the most part that typical design configuration has only two major components. Item #122 comprises on the extreme left hand side, the eleven pyramids of Item #106 shown mating with its twin the eleven pyramids of Item #105 as being shown on the extreme right hand side. The reader must note that all twenty-two pyramids are similarly numbered as being Item #122; which total number represents the first major component. Whereas, Item #123 as the second major component represents the clear diamond shaped configuration formed from the pattern of these alternating side by side pyramids. Accordingly, Item #122 must herein be referred to as the area of impedance. Instead, Item #123 must be referred to as the avenue of escape. It also thus becomes a verifiable fact that that the geometry of both Item #122 and Item #123 are exactly equal in physical spatial dimensions and size. Please recognize that this fact becomes rather important.

It must now be fully appreciated that attributable to their equal sizes (viz. both Item #122 and Item #123); and since we now have eleven areas of impedance as Item #122 versus ten Item #123; which are the areas of escape; then we must deduce the following logical conclusion. Let's now assume that along this entire length of FIG. 11 there will undoubtedly be 100% of circulating air currents being swept upward toward the ceiling simply because warm air currents inherently rise upward as being less dense than the cold air. Therefore, it becomes a proven fact that 52% of this warm heated air cannot in fact escape upward via the Item #122 route; simply because the sloping walls of these latter pyramids block their upward travel route. Hence, logic dictates that this 52% of blocked air must shift either to the left or the right and thus enter into Item #123 as the only area of an escape passage upward toward the ceiling. Logic also dictates that this 100% of circulating air currents now begins to crowd Item #123 as the area of escape thus bringing about a greater number of colliding air molecules; which in scientific parlance means that the pressure within Item #123 automatically increases. Hence, the next logical corollary which flows from this proposition is that accordingly the temperature within Item #123 automatically increases as free heat energy; all being produced without benefit of any extra fossil fuel expenditure. However, notwithstanding this added advantage of free additional energy, lets now investigate this induction heating coil process.

Hence, this induction heating coil consists of an electromagnet and an electronic oscillator (not shown) which passes a high-frequency alternating current (AC) through this electromagnet. Thus, this rapidly alternating magnetic field of Item #93 which heats the oil medium also heats the aluminum fin tube assembly of Item #105 and Item #106—FIGS. 8 and 9 via the process of conduction; . . . and as a result thereby generates electrical currents inside the conductor called eddy currents; which is the induction of these induced circular currents within the coil. These eddy currents of Item #93 flow through the resistance (which, is the cross-section of the induction wire coil shown as Item #98) of the material and thus heats it by Joule heating. This latter process in essence is conduction. In pure mathematical parlance this interpolates into Joule's First Law; which states that this power of heating by the induction coil which is thus generated within this THIRD EMBODIMENT becomes proportional to the product of the inherent resistance of the diameter of the induction coil's material wire size, plus the square of the current (or amperage) which will pass through this induction coil of Item #98.

In sum and substance, by varying the exact characteristics of Item #98 which is the coil's wire size diameter (and is also its resistance) in addition to varying the amount of the electric current being sent through this coil at Item #95; we can absolutely predict what temperature will be transferred to the oil medium of Item #96. Thereafter, this temperature or heat created next passes onto the end aluminum fin components of Item #105 and Item #106 by pure conduction. Thus, this highest temperature zone of 230° F. which we can create within the coil is immediately in direct contact with these aluminum fins because of the latter's contact with Item #96. To begin with, we discussed earlier that the desired temperature thus being generated from the SECOND EMBODIMENT as it first enters tubing of Item #88—FIG. 5 is 180° F. Hence, FIG. 6—Item #96 depicts this heated castor oil medium which now has a temperature of 230° F. therein. Oil is the best medium simply because the boiling point of water is 212° F.; therefore, quite clearly we do not want steam. This is the express reason why castor oil as a heating medium is being used for this heat generation process and also because it is polar in nature and can be heated via a microwave oven. Therefore, let's continue our discussion of FIG. 6 by indicating that Item #92 is in fact this 180 degree F. castor oil medium By and large, electricity then is the movement of electrons which will create a charge we can harness to do work; which in our process is meant to generate heat. There are three basic ingredients in the performance of this work or heat. One is voltage, . . . which is the difference in charge between two points in a circuit. Two is current; . . . which is the rate at which this charge is flowing through the coil. Three is resistance; . . . which lies within the coil material and is the coils tendency to resist the flow of this charge. Earlier, we stated on page 23 that this power of Joule heating by the induction coil becomes the product of the resistance by the diameter of the induction wire coil material times the square of the current or the rate that this charge is flowing. Hence, we can define voltage as the amount of potential energy between two points on a circuit. One point has more charge than the other and the difference between the two is the voltage. Think of a tank filled with water. The charge is the amount of water in the tank. The pressure of the water in the tank is the voltage; while the rate of flow is the current.

Please recall that this formula was shown to be $P=I^2 R$. This simply means that the heat evolved per second equals the current or amperage squared times the resistance (which is the diameter of the wire size of the induction coil). It thus becomes a foregone conclusion to deduce that we can vary a number of factors within this formula or equation and thus achieve the sought after temperature desired to heat the aluminum fins of Item #105 and Item #106. We can thus deduce from this Joule's formula that the resistance within the induction coil now becomes a function of the specific diameter size of that wire for the induction coil of Item #98. Next, we also know that we can alter the current or amperage flowing through that latter coil by use of a rheostat, which is a variable resistor used to control current. We can also spread out the interval distance or spacing from one ascending diagonal leg of the induction coil to the next immediate adjoining ascending leg; . . . instead of the wires being spaced in close proximity to one another. Thus, the P within Joule's Law is the desired heat output we wish to achieve; and where $I^2$ squared is the current we provide; while the resistance R is the diameter of the induction coil itself.

The invention claimed is:

1. A process of producing desired home heating energy comfort to a residential dwelling, a first step comprises these necessary procedural steps as follows: . . . digging a geometric shaped crypt of a certain length, width, and depth immediately adjacent to the homeowner's dwelling within the soil thereof, such that subsequently said crypt can be reinforced with structural materials which completely enclose the entire perimeter of said crypt, as well as the floor thereof; and which crypt is also subsequently outfitted with a circular galvanized steel wire mesh cage, the center of which houses a polyvinyl chloride perforated pipe which contains two separate and distinct vinyl reinforced flexible hoses; whereby these latter hoses then travel into the interior of said dwelling which contain within their interior tubular cavity a fluid oil medium; the purpose of which becomes apparent after said circular cage is completely filled with a variety of organic discarded refuse matter, along with an interspersed variety of invertebrates, predominantly consisting of worms and nematodes; whereby the latter's enzymatic activity upon said organic refuse matter results in the exothermic reaction of producing desired free heat energy which energy is subsequently transferred by conduction to said oil medium; whereby aiding and abetting this entire decomposition process is a uniquely designed lid cover assembly which aerates, irrigates and rotates said organic waste matter; a second step comprises these necessary procedural steps as follows: connecting that one supply vinyl flexible hose emanating from said polyvinyl chloride perforated pipe of the first step, from which it subsequently then terminates in the attic space of said dwelling; whereupon said ensuing connections therefrom result in adding a circulating in-line pump, thence connecting a certain size rigid polyvinyl chloride tubular pipe material fashioned as such into an array of vertical rows situated end on end, whereby said tubular pipe array, thus being outfitted at each end within the heating compartment, thus subsequently terminates therein with many "U" shaped return elbows, such that this serial arrangement of vertical end on end rows imparts a unidirectional alternating flow, thus resulting into a . . . to and fro movement of said oil medium from the first step; which further results in a downward flow direction within the first row, followed by an upward flow direction within the second row; hence thereby alternating back and forth as such until the entirety of the heating compartment is fully utilized in plenary fashion and alternating flow from one adjoining vertical row to the very next adjoining vertical row in this very same manner; whereupon said pipe tubing then subsequently exits the rear of said heating compartment; whereupon the desired heat within said heating compartment translates as follows; . . . a thermostat, upon sensing a low temperature reading in said dwelling enervates an ordinary 110 volt household current as the primary winding to a step-up transformer of the secondary winding which then increases ten-fold said electric current surge therein to thus activate the positively disposed anode of a plurality of evacuation chambers thus coated with a metallic oxide material containing numerous electrons; . . . whereby said high voltage knocks off and dislodges said electrons from said metallic oxide coating and thus produces an electromagnetic circulating field which surrounds the centrally located negatively charged cathode; thus firing an emissive amount of microwave energy being transmitted to a wave guide apparatus which imparts said energy thus imbued with tremendous vibrating potential magnitude which evolves into a vibratory force amounting to billions per second of giga-hertz radio sine wave vibrations and transfers this energy to the polarized oil medium which then immediately heats up internally as a result shortly before said poly vinyl tubing exits said heating compartment on its subsequent journey to a third step.

2. The process of producing desired home heating energy comfort to a residential dwelling according to claim 1, the third step comprises: connecting the exiting polyvinyl chloride tubing from the rear of the heating compartment of the second step and uniting said connection into two separate certain size iron ferrous pipe tubes; each of which becomes imbedded into a geometric fused pyroceramic housing envelope, from which said pipe tubing has wrapped around each of its respective circumference of said pipes; . . . a wire metallic induction heating coil enervated from an outside source of electric current, such that a typical smart household thermostat upon sensing a low temperature reading within said dwelling enervates said ordinary 240 volt household current into producing an electromagnetic eddy current electrical field radiating throughout said pyro-ceramic housing envelope and thus producing the desired heat energy within the tubular lumen cavity of said iron ferrous pipe, which contains the same ubiquitous aforementioned oil medium within its interior tubular cavity which subsequently flows into a continuing network of certain sized rigid copper pipe material containing along its entire length a multitudinous series of alternating thin aluminum panel plates, each one configured with stamped out four-sided pyramidal projections; such that the apices of one panel are aligned and positioned exactly in a manner whereby said adjoining apices touch and intimately mate one another by touching, such that the entire underside of said aluminum panels now imparts a blockage of the upward travel of warm circulating convection air currents; thus leaving only the adjacent voids created by the geometric pattern produced from the sloping sides of each adjoining pyramid; whereupon this remaining sole means of escape upward thus becomes congested with a greater multiple of thermomolecular air molecules which translates into a greater amount of pressure therein within said escape void routes such that this automatic congestion pressure correspondingly thus creates an automatic concomitant increase in temperature within the aluminum fin tube assembly; thereby completing this tri-partite cycle of repetition over and over again as this copper pipe/aluminum fin tube assembly returns its spent oil medium energy back to the return tubing of the first step and into the composting bin awaiting its soon destined upward travel back to the dwelling's attic in an attempt to repeat and renew this heating cycle once again into the second step and from there onward to the third step.

* * * * *